US007979919B2

(12) United States Patent
Joran

(10) Patent No.: US 7,979,919 B2
(45) Date of Patent: Jul. 19, 2011

(54) FULL BODY HARNESS

(75) Inventor: Omar P. Joran, Twinsburg, OH (US)

(73) Assignee: Rapid Intervention Technologies, Inc., Twinsburg, OH (US)

( * ) Notice: Subject to any disclaimer, the term of this patent is extended or adjusted under 35 U.S.C. 154(b) by 1450 days.

(21) Appl. No.: 11/332,518

(22) Filed: Jan. 13, 2006

(65) Prior Publication Data

US 2009/0127396 A1 May 21, 2009

Related U.S. Application Data

(63) Continuation-in-part of application No. 10/740,993, filed on Dec. 19, 2003, now Pat. No. 7,086,091.

(60) Provisional application No. 60/434,933, filed on Dec. 19, 2002, provisional application No. 60/495,985, filed on Aug. 18, 2003.

(51) Int. Cl.
*A41D 13/00* (2006.01)

(52) U.S. Cl. ..... 2/69

(58) Field of Classification Search ..... 2/69, 79, 2/81, 94, 108, 97, 227, 44, 92, 69.5; 244/138 R, 244/151 R, 142
See application file for complete search history.

(56) References Cited

U.S. PATENT DOCUMENTS

| | | | | |
|---|---|---|---|---|
| 702,858 | A | | 6/1902 | Hendricks et al. |
| 1,967,767 | A | | 7/1934 | Diez |
| 2,156,210 | A | | 4/1939 | Upson |
| 2,166,809 | A | | 7/1939 | Frankel |
| 2,252,998 | A | | 8/1941 | Wachtel |
| 2,290,218 | A | | 7/1942 | Vosseller |
| 2,729,425 | A | | 1/1956 | Gschwind |
| 3,074,074 | A | | 1/1963 | Lovering |
| 3,692,262 | A | * | 9/1972 | Gaylord ..... 244/151 A |
| 3,717,219 | A | | 2/1973 | Hoffman |
| 3,880,255 | A | | 4/1975 | Huntley |
| 3,973,643 | A | | 8/1976 | Hutchinson |
| 4,161,266 | A | | 7/1979 | Howarth, Jr. |
| 4,273,216 | A | | 6/1981 | Weissmann |
| 4,302,847 | A | | 12/1981 | Miles |
| 4,446,943 | A | | 5/1984 | Murray |
| 4,449,253 | A | | 5/1984 | Hettinger |
| 4,538,704 | A | | 9/1985 | Forrest |
| 4,625,335 | A | | 12/1986 | Vinai |
| 4,674,599 | A | | 6/1987 | Nelson |

(Continued)

FOREIGN PATENT DOCUMENTS

DE 316581 3/1918

(Continued)

OTHER PUBLICATIONS

Supplemental EP Search Report date May 9, 2007.

(Continued)

*Primary Examiner* — Tejash Patel
(74) *Attorney, Agent, or Firm* — Pearne & Gordon LLP

(57) ABSTRACT

A full-body harness, with or without an integral support line, with the harness being adaptable for class I, class II, and/or class III service, and for use by safety personnel (such as firefighters, military personnel, rescue workers etc.) or others for situations that call for emergency activity in areas where falls from an unsafe height are possible, or for use for entertainment purposes such as climbing, rappelling, or skydiving, for example.

23 Claims, 18 Drawing Sheets

U.S. PATENT DOCUMENTS

| | | | | | |
|---|---|---|---|---|---|
| 4,706,858 | A | | 11/1987 | Whatley | |
| 4,714,135 | A | | 12/1987 | Bell et al. | |
| 4,731,882 | A | | 3/1988 | Ekman | |
| 4,746,084 | A | * | 5/1988 | Strong | 244/151 R |
| 4,793,575 | A | * | 12/1988 | Butler | 244/148 |
| 4,802,264 | A | | 2/1989 | Isenhart | |
| 4,850,554 | A | | 7/1989 | Strong | |
| 4,854,418 | A | | 8/1989 | Hengstenberger et al. | |
| 4,938,435 | A | | 7/1990 | Varner et al. | |
| 4,955,456 | A | | 9/1990 | Mulkey | |
| 5,024,360 | A | | 6/1991 | Rodriguez | |
| 5,036,548 | A | | 8/1991 | Grilliot et al. | |
| 5,136,724 | A | | 8/1992 | Grilliot et al. | |
| 5,277,348 | A | * | 1/1994 | Reid | 244/151 R |
| 5,278,590 | A | | 1/1994 | Phillips et al. | |
| 5,289,590 | A | | 3/1994 | Larson | |
| 5,329,884 | A | | 7/1994 | Bell | |
| 5,351,340 | A | | 10/1994 | Aldridge | |
| 5,450,627 | A | | 9/1995 | Grilliot et al. | |
| 5,487,444 | A | | 1/1996 | Dennington | |
| 5,542,124 | A | | 8/1996 | Grilliot et al. | |
| 5,548,842 | A | | 8/1996 | Wiseman, Sr. | |
| 5,581,901 | A | | 12/1996 | Takahashi | |
| 5,611,085 | A | | 3/1997 | Rasmussen | |
| 5,671,822 | A | | 9/1997 | Phillips | |
| 5,781,118 | A | | 7/1998 | Wise et al. | |
| 5,815,834 | A | | 10/1998 | Bronson | |
| 5,842,542 | A | | 12/1998 | Tien | |
| 5,878,833 | A | | 3/1999 | Bell | |
| 5,970,517 | A | | 10/1999 | Jordan | |
| 6,012,993 | A | | 1/2000 | Guerriero | |
| 6,050,364 | A | | 4/2000 | Popall et al. | |
| 6,128,782 | A | | 10/2000 | Young et al. | |
| 6,189,651 | B1 | | 2/2001 | Sadeck | |
| 6,244,379 | B1 | | 6/2001 | Larson | |
| 6,308,335 | B1 | | 10/2001 | Colorado | |
| 6,367,582 | B1 | * | 4/2002 | Derby | 182/3 |
| 6,374,946 | B1 | | 4/2002 | Petzl et al. | |
| 6,427,452 | B2 | | 8/2002 | Lewis et al. | |
| 6,487,725 | B1 | | 12/2002 | Jordan | |
| 6,490,733 | B1 | | 12/2002 | Casaubon | |
| 6,554,747 | B1 | | 4/2003 | Rempe | |
| 6,658,666 | B2 | | 12/2003 | Schweer | |
| 6,732,834 | B2 | | 5/2004 | Colorado | |
| 6,824,106 | B2 | * | 11/2004 | Douglas et al. | 244/151 R |
| 7,086,091 | B2 | | 8/2006 | Jordan | |
| 2002/0158098 | A1 | | 10/2002 | Price | |
| 2003/0015905 | A1 | | 1/2003 | Sappei et al. | |
| 2004/0140152 | A1 | | 7/2004 | Richardson | |

FOREIGN PATENT DOCUMENTS

| | | | |
|---|---|---|---|
| DE | 3532011 | A1 | 3/1987 |
| EP | 0584521 | A1 | 3/1994 |
| FR | 859964 | A | 1/1941 |
| FR | 862431 | A | 3/1941 |
| FR | 2580182 | A1 | 10/1986 |
| FR | 2649618 | A1 | 1/1991 |
| WO | 0047098 | A1 | 8/2000 |

OTHER PUBLICATIONS

Harness Butterfly (KOMET) published in a KOMET catalogue, Jun. 2001.

* cited by examiner

FULL BODY HARNESS

CROSS-REFERENCES TO RELATED APPLICATIONS

This application is a continuation-in-part of U.S. patent application Ser. No. 10/740,993 filed on Dec. 19, 2003, and incorporated herein by reference in its entirety.

U.S. patent application Ser. No. 10/740,993, and thereby this application, claims the benefit of provisional application Ser. No. 60/434,933 filed on Dec. 19, 2002 and provisional application Ser. No. 60/495,985, filed on Aug. 18, 2003, both documents incorporated herein by reference in their entirety.

FIELD OF THE INVENTION

This application relates generally to a body harness, and also to a full body harness with integral support line for emergency crews or for general safety use.

More specifically, this application relates to a harness adaptable for class I, class II, and/or class III service for use by safety personnel (such as firefighters, for example) for situations that call for emergency activity in areas where falls from an unsafe height are possible (such as rescues from skyscrapers, cliffs, or other raised locations, for example).

BACKGROUND OF THE INVENTION

Firefighters traditionally wear outer clothing that is known in the art as turnout gear. Turnout gear includes a large coat and pants that typically have an inner liner and an outer layer. The outer layer or shell is usually constructed from materials that are resistant to abrasion, flame, heat, and water.

In addition to the turnout gear coat and pants, firefighters also wear a helmet, thick gloves, and a large oxygen tank. As can be appreciated, the equipment is heavy and bulky, and there is understandably a great resistance by firefighters to add any further equipment to what is already in use.

Unfortunately, for firefighters entering a burning building, especially a high-rise building, the conventional equipment typically does not include means to facilitate escape from a window or roof of the building. Moreover, for a firefighter who is injured and incapable of escaping from the building, the conventional equipment does not include means to facilitate lifting, lowering, or dragging the injured firefighter from the building.

In the past, an unsatisfactory solution to this problem has been to carry lengths of rope in a coat pocket (which can be lost or difficult to retrieve) or a coil of rope over-the-shoulder (which can get snagged on things in the building, be dropped, or is otherwise inconvenient for the firefighter to carry). Alternatively, firefighters may utilize bulky and complex body harnesses that may be easily entangled and difficult to put on properly, leading to excessive dress time and delays. Therefore, it is common for firefighters to enter tall buildings during a fire either without a support line or harness, or with an unreliable support line or a harness improperly fitted or fastened together, which can lead to failure of the rescue equipment when it is needed most. Further, when a firefighter is incapacitated, he must be physically lifted and carried, or dragged by his coat by a rescuer, which can greatly burden another rescuer.

Therefore, there exists a need in the art for a means to facilitate escape from upper floors of a building which incorporates a full-body harness that meets or exceeds current safety requirements, is easily adjustable for individual firefighters, and is easy to put on and take off. There also exists a need in the art for a means and method for rescuing incapacitated people from buildings. Finally, there exists a need in the art for firefighter turnout gear that incorporates such escape and rescue means.

A number of harnesses have been developed in an attempt to satisfy some of the above determined needs. For example, U.S. Pat. Nos. 5,970,517 and 6,487,725 to the present inventor, both incorporated herein by reference, disclose a harness with an integrated support line.

Many of the harness units that currently exist have a number of problems and shortcomings. For example, the connecting ends of current harnesses, when unbuckled, may lead to the harness device getting separated and spread out, such that it can be difficult for the wearer to easily find the ends to strap the harness together, or the harness might get tangled up in firefighting clothing or in the support lines. Further, many currently available harnesses are limited in their ability to be adjusted to closely fit the individual, and thus can be uncomfortable when worn, or even maladjusted, preventing their proper functioning. Even further, many existing harnesses may become entangled or are difficult to properly adjust and are difficult to put on and/or take off, leading to delays in getting the firefighter to the rescue.

Furthermore, there are three basic types of harnesses for emergency work defined by the National Fire Protection Association (NFPA) as defined in the NFPA 1983: Standard on Fire Service Life Safety Rope and System Components, incorporated herein by reference.

A class I harness is primarily a positioning belt to catch the wearer if he slips, and is for personal egress. A Class I harness fastens around the waist and around thighs or under buttocks, and is designed to be used for emergency escape with a design load of about three hundred lbf or more. A class II harness is suitable for rappelling work and is one that fastens around the waist and around the thighs or under the buttocks, and is designed for rescue with a design load of six hundred lbf or more. Finally, a class III harness is a full-body harness that fastens around the waist or chest, around the thighs or under the buttocks, and over the shoulders, and is designed for rescue with a design load of six hundred lbf or more and which provides maximum fall protection.

It would be beneficial to have a single design that could satisfy all of these needs, and be adjustable to be utilized as a Class I, Class II, or a Class III harness.

Finally, current system configurations of various personnel lowering devices (PLDs) utilize nylon webbing, antiquated descending devices and small snap hooks and rings. Such a system requires two hands to deploy and operate. Several problems are that they are bulky and difficult to operate, may melt if the user descends is too fast, and become tangled easily. The user must pull out the system, connect the descending device to the parachute harness, and finally wrap the nylon webbing with the ring around the riser. Without being able to see the connection, the user must connect the snap hook to the small ring. This is very difficult even when you able to see the connection point. The snap hook and ring are very small and difficult to use with gloved hands. The tensile strength of the hardware and webbing is questionable. Too many steps are needed to deploy and use. Once the steps are completed, the user must feed the Nylon webbing through the descending device perfectly straight. If not, the webbing could tangle. The user must descend at a slow rate to prevent heat build up and melting the Nylon webbing.

SUMMARY OF THE INVENTION

Provided is a harness comprising: a first configuration for making the harness a class I harness; a second configuration for making the harness a class II harness; and a third configuration for making the harness a class III harness. Each of the configurations can be implemented by a user configuring the harness while putting it on.

Also provided is a harness comprising: a harness body portion and one or more of a leg strap, a chest strap, a back strap, and a shoulder strap (with the shoulder strap having a shoulder pull handle for adjusting the shoulder strap). The harness also comprising a support line module including a support line with the support line module and the harness body portion being secured to one another.

Further provided is a harness comprising a harness body portion including: a first configuration for making the harness a class I harness; a second configuration for making the harness a class II harness; and a third configuration for making the harness a class III harness. Each of the configurations can be implemented by a user configuring the harness while putting it on.

The above harness also comprises a support line module including a support line. The support line module and the harness body portion are secured to one another in the above harness.

Also provided is a harness comprising: a harness body portion having a first end and a second end; a fastener for releasably securing the first end to the second end to releasably secure the harness body portion around a user; and a support line module containing a support line.

The support line module and the harness body portion of the above harness are releasably secured to one another, and the support line has a first end which can be extended from the support line module and a second end that is releasably secured to one of the harness body portion and the support line module.

The above harness also comprises a leg strap, with one part connected to the harness body portion and another part releasably secured to the harness body portion for wearing around the legs of the user. The above harness also comprises a shoulder strap with one part connected to the harness body portion and another part releasably secured to the harness body portion for wearing around the shoulders and chest of the user.

Still further provided is harness comprising: a shoulder strap for wearing across the shoulder of a user and a waist strap assembly connected to the shoulder strap. The ends of the waist strap assembly can be buckled across the waist of the user.

The harness also comprises a leg strap connected to the shoulder strap. The waist strap is connected to the leg strap. The harness is adjustable for providing: a first configuration for making the harness a class I harness; a second configuration for making the harness a class II harness; and a third configuration for making the harness a class III harness. Each of the configurations can be implemented by a user configuring the harness while putting it on.

Also provided is harness comprising: a left shoulder strap for wearing across the left shoulder of a user; a right shoulder strap for wearing across the right shoulder of a user and connected to the left shoulder strap; and a waist strap assembly connected to the left shoulder strap and connected to the right shoulder strap. The waist strap assembly can be buckled across the waist of the user.

The harness also comprises a left leg strap for wearing across the left leg or left thigh of the user and connected to the right shoulder strap; and a right leg strap for wearing across a right leg or right thigh of the user and connected to the left shoulder strap. The left leg strap and the right leg strap are connected to each other, and the waist strap is connected to the right leg strap and also connected to the left leg strap.

Even further provided is a harness comprising: a left shoulder strap; a right shoulder strap connected to the left shoulder strap for wearing behind a user and also connected to the left shoulder strap for wearing in front of the user; a right waist strap connected to one or both of the right shoulder strap and the left shoulder strap; a left waist strap connected to one or both of the right shoulder strap and the left shoulder strap; a waist buckle assembly for connecting the left waist strap to the right waist strap for wearing around the waist of the user; a leg buckle assembly for connecting to the waist buckle assembly; a left leg strap for crossing a left leg or left thigh of the user connected to the leg buckle assembly and also connected to one or both of the right shoulder strap and the left shoulder strap; and a right leg strap for crossing a right leg or right thigh of the user connected to the leg buckle assembly and also connected to one or both of the right shoulder strap and the left shoulder strap.

Also provided is a harness comprising: a left shoulder strap; a right shoulder strap connected to the left shoulder strap at a central back connection point for wearing across the back of a user; a chest strap for wearing across the chest of the user and connected to the right shoulder strap and also connected to the left shoulder strap; a back strap connected to the right shoulder strap and also connected to the left shoulder strap; a right waist strap connected to the back strap; a left waist strap connected to the back strap; a waist buckle assembly for connecting the left waist strap to the right waist strap for wearing around the waist of the user; a leg buckle assembly for connecting to the waist buckle assembly; a left leg strap for wearing across a left leg or left thigh of the user and connected to the leg buckle assembly and also connected to the back strap and also connected to the right shoulders strap; and a right leg strap for wearing across a right leg or right thigh of the user and connected to the leg buckle assembly and also connected to the back strap and also connected to the left shoulder strap.

And further provided is a harness comprising: a left shoulder strap including: a first left shoulder strap end having a right shoulder strap pull handle; and a second left shoulder strap end; a right shoulder strap including: a first right shoulder strap end having a left shoulder strap pull handle and adjustably connected to the second end of the left shoulder strap for adjusting the left shoulder strap via the left shoulder strap pull handle; and a second right shoulder strap end adjustably connected to the first left shoulder strap end for adjusting the right shoulder strap via the right shoulder strap pull handle.

The right shoulder strap of the above harness is connected to the left shoulder strap at a central back connection point for crossing the back of a user.

The above harness further comprises a chest strap including a chest pull handle and a buckle at one end for adjusting the chest strap, the chest strap for crossing the chest of the user and being connected to the right shoulder strap at one of the one end and another end and also connected to the left shoulder strap at the other of the one end and the another end; a back strap including: a first back strap end; and a second back strap end.

The back strap of the above harness is moveably connected to the right shoulder strap near the first end and moveably connected to the left shoulder strap near the second end.

The above harness further comprises a right waist strap including: a first right waist strap end having a right waist strap pull handle; and a second right waist strap end connected to the second end of the back strap.

The above harness further comprises a left waist strap including: a first left waist strap end having a left waist strap pull handle; and a second left waist strap end connected to the first end of the back strap.

The above harness further comprises a waist buckle assembly for releasably connecting the first left waist strap end to the first right waist strap end across the waist of the user; a leg buckle assembly for releasably connecting to the waist buckle assembly; a left leg strap including: a first left leg strap end having a left leg pull handle; and a second left leg strap end connected to the leg buckle assembly.

The left leg strap is for crossing a left leg or left thigh of the user, and the left leg strap is adjustably connected to the back strap for adjusting the left leg strap via the left leg strap pull handle.

Finally, the above harness also comprises: a right leg strap including: a first right leg strap end having a right leg pull handle; and a second right leg strap end connected to the leg buckle assembly.

The right leg strap of the above harness is for crossing a right leg or right thigh of the user, and the right leg strap is adjustably connected to the back strap for adjusting the right leg strap via the right leg strap pull handle.

Further provided is the above harness further comprising a support line module containing a support line, the support line module and the harness being releasably secured to one another, wherein the support line has a first end which can be extended from the support line module and a second end being releasably secured to one of the harness and the support line module.

The above harness is adjustable for providing: a first configuration for making the harness a class I harness; a second configuration for making the harness a class II harness; and a third configuration for making the harness a class III harness. Each of the configurations of the above harness can be implemented by a user configuring the harness while putting it on.

DETAILED DESCRIPTION OF THE PREFERRED EMBODIMENTS

Provided is an adaptable full-body harness with integral support line, as described hereinbelow, which can be worn as a class I, class II, and/or class III harness, depending on the straps that are buckled. The harness assembly can be removably fastened to the interior of an outer garment, such as a firefighter's turnout gear, or to a self-contained breathing apparatus (SCBA).

The harness assembly includes a harness body which is primarily a waist or chest belt meeting the requirements of a class I harness. The harness body may include a support line module, in which the support line is received and stored, is movable relative to the harness body, is accessible from an exterior of the outer garment, and is more easily deployed.

The harness further includes leg straps that, when utilized as specified herein, transform the harness into a class II harness. Further included are shoulder straps that may be attached to the harness body for modification to a class III harness. These straps may be stored in pouches attached to the harness when not in use. Thus, by varying the components being fastened and utilized, the harness can be converted from a class I harness (e.g., using the harness body only) to a class II harness (e.g., adding use of the leg/buttocks straps), and finally to a class III harness (e.g., utilizing the shoulder straps) for maximum fall protection.

The full-body harness is substantially constructed from a sufficiently strong strap material to support a firefighter carrying firefighter equipment, with various portions of the strap sewn together in a manner to maintain the proper strength, such as the device described above. Further, various portions of the straps can be further covered with a material to protect the strap, avoid chafing human skin, or to protect other garments against abrading and/or chafing during use, for example. Additional material can also be added with padding, if desired, for a more comfortable wearing experience, and the harness can be modified to integrate with additional firefighting equipment, for example.

Figure 1:
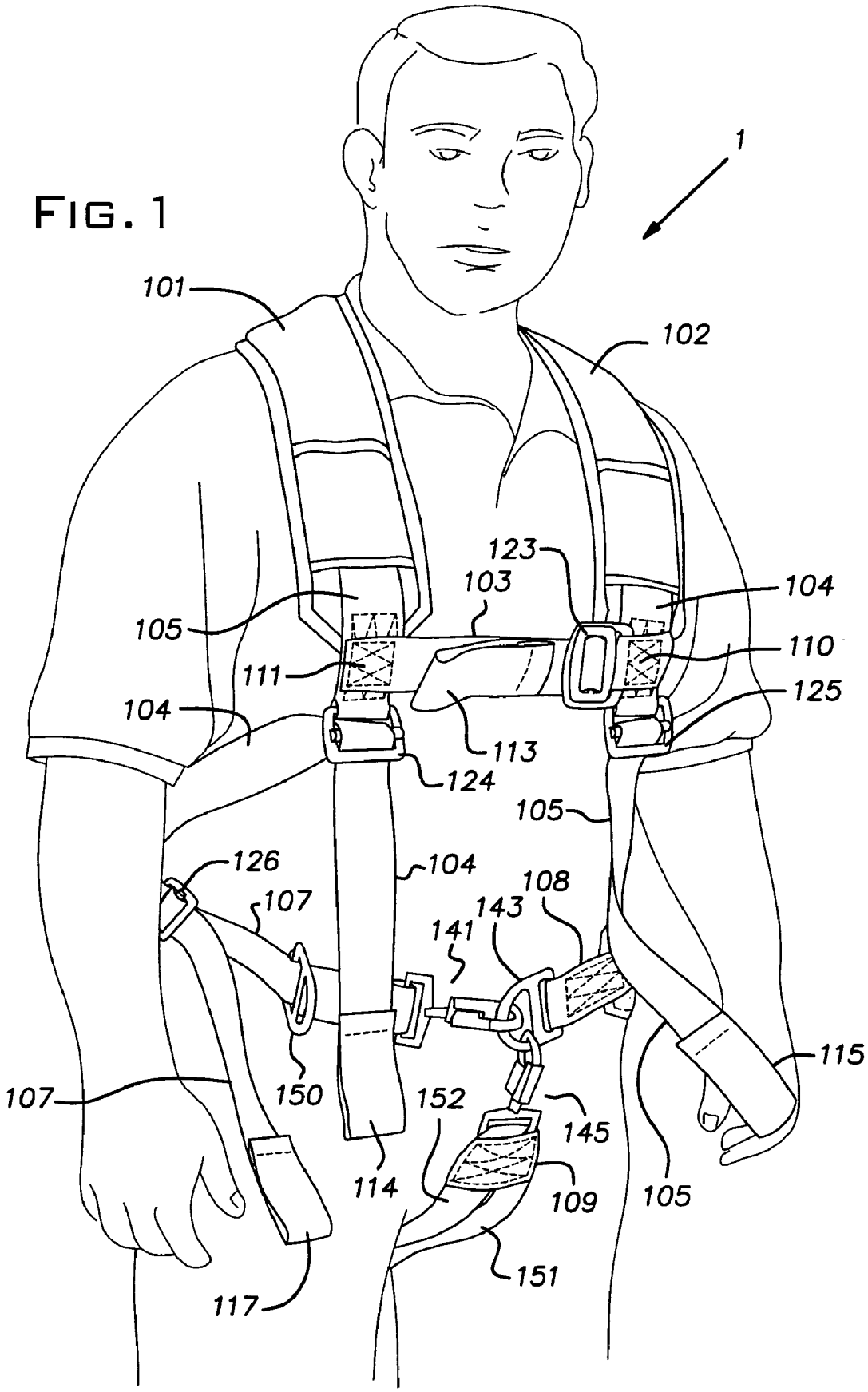
FIG. 1 shows a schematic of a front view of an embodiment of the full-body harness being worn by an individual.
Figure 2:
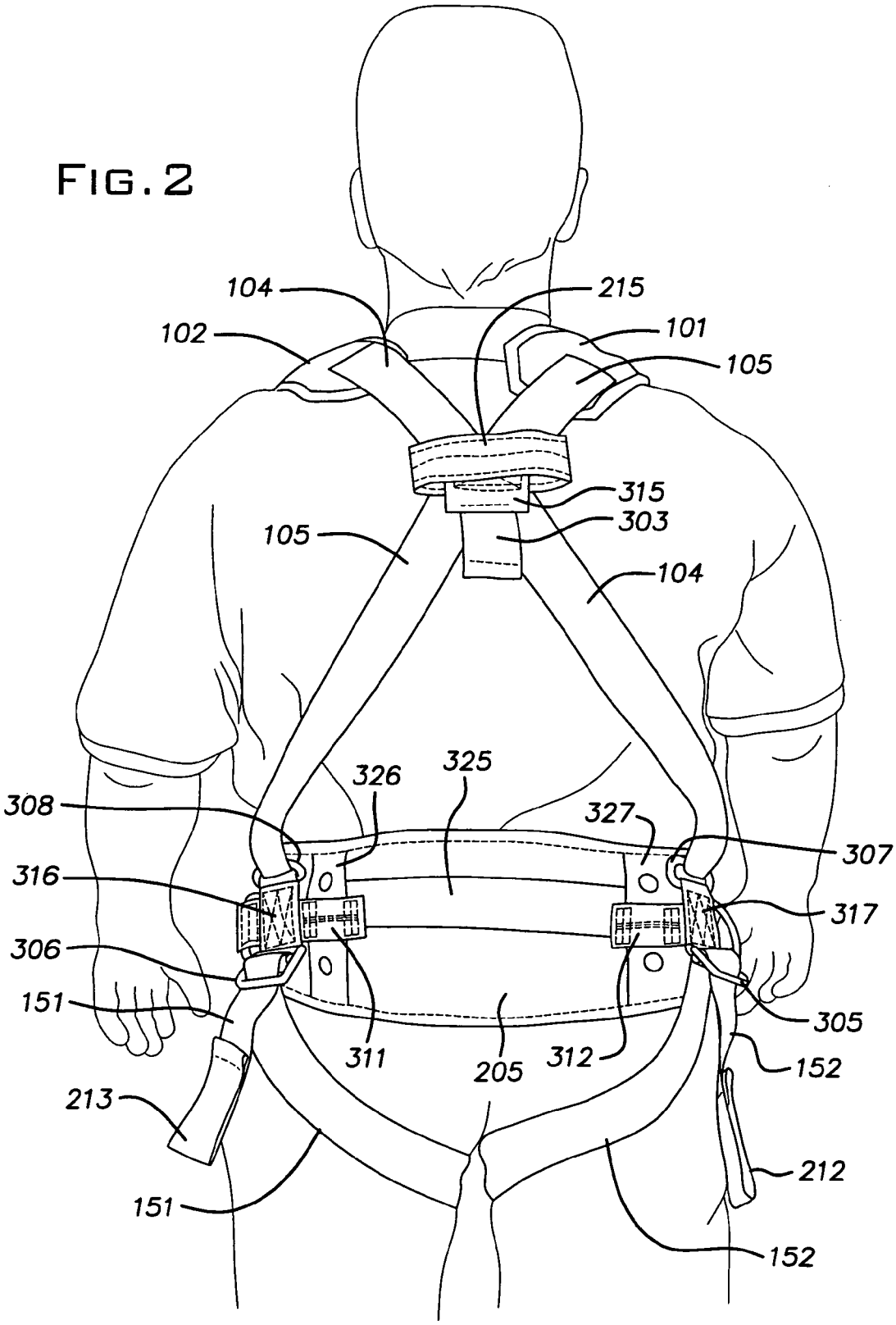
FIG. 2 shows a schematic of a back view of an embodiment of the full-body harness being worn by an individual.

FIG. 1 shows one possible preferred embodiment of the full-body harness being worn by an individual 1, while FIG. 2 shows a corresponding back view. Additional embodiments are also contemplated that are within the scope of the invention but not necessarily shown. Note that directions (such as front and back, up and down, or left and right) are taken from the perspective of the individual 1 who is properly wearing the full-body harness.

The individual 1 is shown in FIG. 1 with the preferred embodiment of the full-body harness 100 (hereinafter the full-body harness) (see also FIG. 3); worn in a proper fashion. The full-body harness is substantially constructed from a sufficiently strong strap material to support a firefighter carrying firefighter equipment, with various portions of the strap sewn together in a manner to maintain the proper strength. Further, various portions of the straps can be further covered with a material to protect the strap, avoid chafing human skin, or to protect other garments against abrading and/or chafing during use, for example. Additional material can also be added with padding, if desired, for a more comfortable wearing experience, and the harness can be modified to integrate with additional firefighting equipment, for example.

Figure 3:
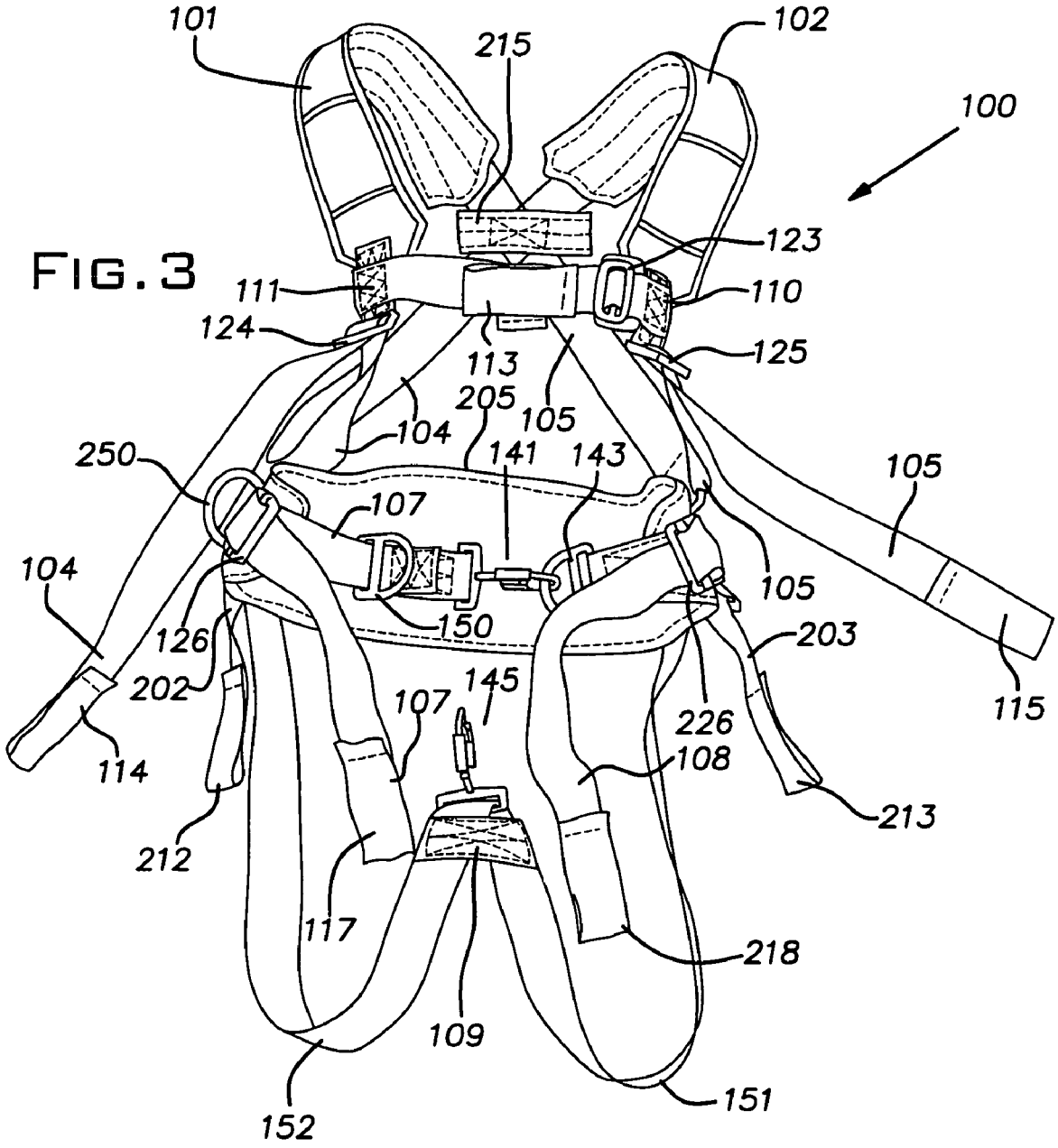
FIG. 3 shows a schematic of a front view of the embodiment of the full-body harness.

FIG. 3 shows a front view of the full-body harness 100 without the individual 1. As shown in FIGS. 1 and 3, the full-body harness has a right shoulder strap 105, covered with a right shoulder pad 101, said right shoulder strap 105 going through the right shoulder pad 101, over the individual's right shoulder. Also shown is a left shoulder strap 104, covered with and going through a left shoulder pad 102, said left shoulder strap 104 going over the individual's left shoulder. The shoulder pads 101, 102 are provided to increase comfort by distributing shoulder strap forces across a larger area, and the shoulder pads 101, 102 can be padded for additional comfort.

Shoulder straps 104 and 105 are connected to opposite ends of a chest strap 103, respectively, near first ends of shoulder straps 104, 105. A first end of left shoulder strap 104 is connected to a left shoulder adjusting buckle 125, while a first end of right shoulder strap 105 is similarly connected to a right shoulder adjusting buckle 124. Each first end is preferably connected to the corresponding shoulder buckle 124, 125 by looping the first end through the corresponding buckle and then sewing the end of each strap at a respective right and left connection point 111, 110.

The chest strap 103 can be tightened by pulling a chest pull handle 113 connected to a first end of the chest strap 103. Pulling the chest pull handle 113 pulls a portion of the chest strap 103 through a chest buckle 123, which, when the full-body harness is worn, grips and holds the chest strap 103 in a tightened position. The chest strap 103 can be loosened by pushing the chest strap 103 back through the chest buckle 123, for example. Tightening the chest strap 103 also tends to tighten the right and left shoulder straps 104, 105 to some extent, and tends to bring their ends closer together.

The chest buckle 123 is connected to the left shoulder strap 104 at left connection point 110 by looping a short length of strap through the buckle 123 and sewing the ends of the short length of strap to the left shoulder strap 104 at left connection point 110. A second end of the chest strap 103 is connected to the right shoulder strap 105 at connection point 111. The connection can be made by sewing the straps together, for example.

The chest pull handle 113 can be a separate component connected to the end of the chest strap 103, or, preferably, the chest pull handle 113 is integrally formed by looping the end of the chest strap 103 back onto itself and fastening the end to a portion of the strap 103, thus creating the pull handle.

The chest strap 103 can be fastened and unfastened by utilizing the chest buckle 123. Chest buckle 123 could be chosen from any of a number of different buckle types, with preference to those that are quickly and easily fastened, but unlikely to spontaneously unfasten when the full-body harness is properly worn. Further, the chest buckle 123 preferably allows the length of the chest strap to be adjusted. The buckles chosen should allow the length of the chest strap 103 to be adjusted, and tend to stay fastened when the chest strap 103 is under tension, and also allowing a relaxing of the strap tension for the buckle to be unbuckled, making inadvertent or spontaneous unfastening unlikely.

The right shoulder strap 105 is further adjusted by pulling a right shoulder pull handle 114. The right shoulder pull handle 114 can be a separate component connected to a second end of the left shoulder strap 104, or, preferably, the right shoulder pull handle 114 is integrally formed by looping the second end of the left shoulder strap 104 back onto itself and fastening the second end to a portion of the strap 104, thus creating the pull handle 114. Pulling the right shoulder pull handle 114 pulls a portion of the left shoulder strap 104 through the right shoulder adjusting buckle 124, which, when the full-body harness is worn, thereby grips and holds the left shoulder strap 104 in a tightened position, thereby adjusting the right shoulder strap 105.

Figure 5:
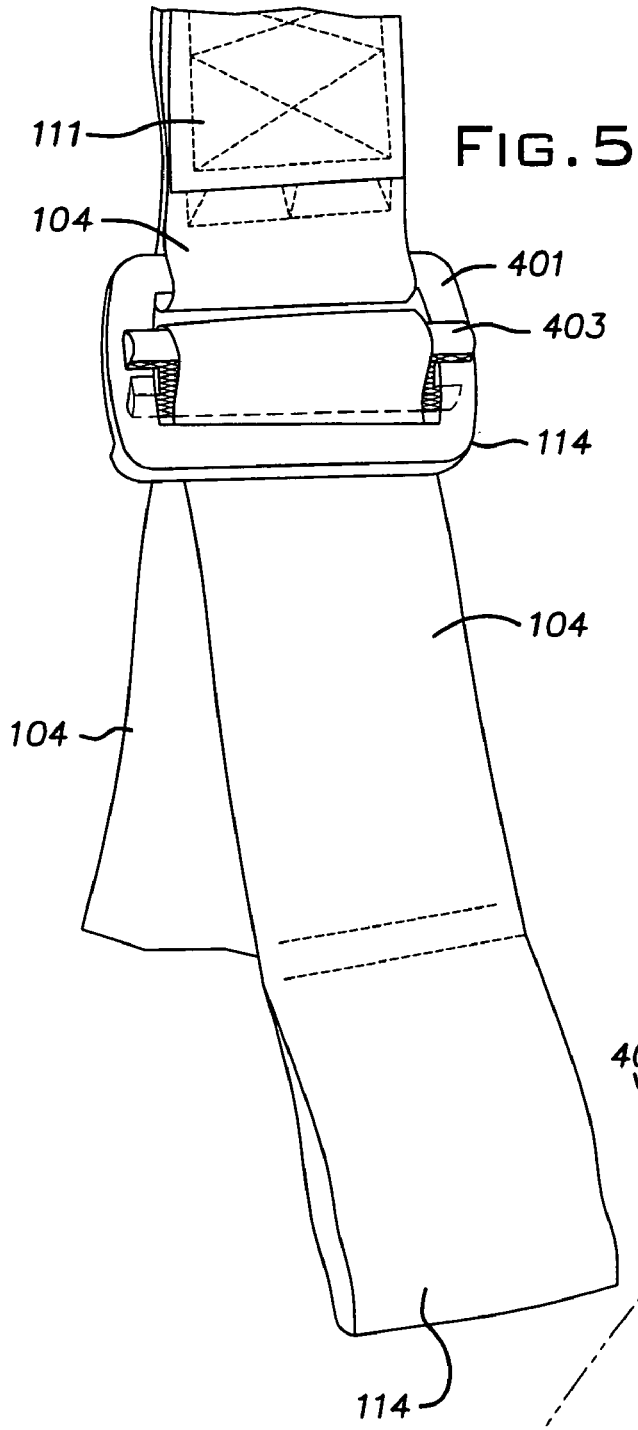
FIG. 5 shows a schematic of a close up of an example adjusting buckle for the embodiment of the full-body harness.
Figure 6:
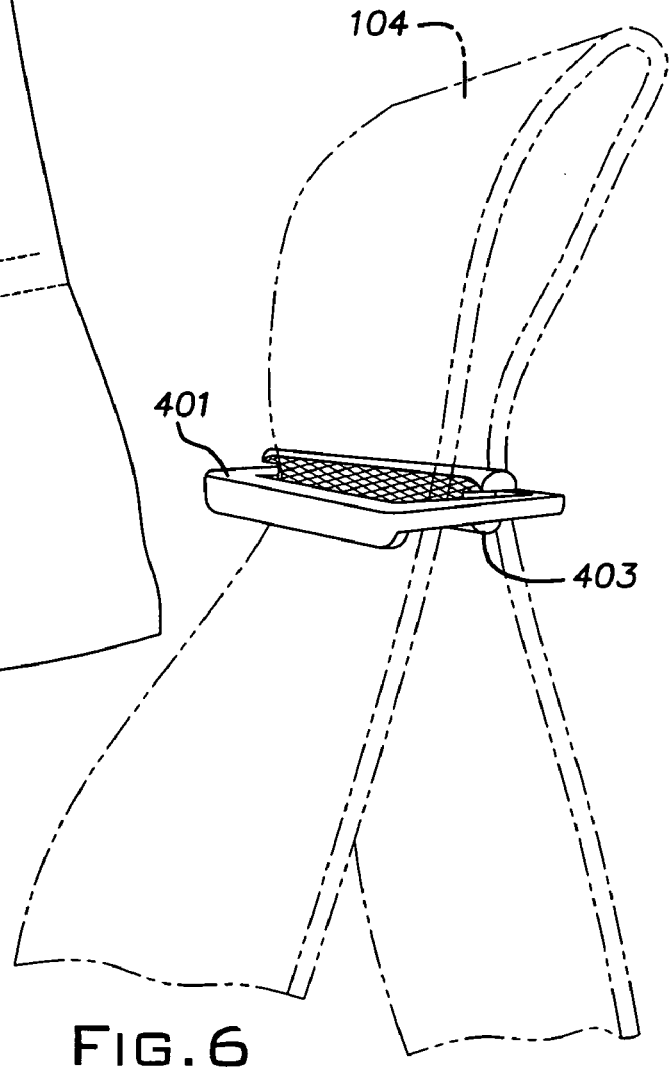
FIG. 6 shows a schematic of a close up of an example adjusting buckle for the embodiment of the full-body harness with the straps loosened and in phantom.

FIGS. 5 and 6 show one preferred design of the right shoulder buckle 124 in more detail, the operation of which can also be generally applied to the other strap adjusting buckles described herein.

Referring back to FIGS. 1 & 3, the left shoulder strap 104 is adjusted in a similar manner, by pulling a left shoulder pull handle 115. The left shoulder pull handle 115 can be a separate component connected to a second end of the right shoulder strap 105, or, preferably, the left shoulder pull handle 115 is integrally formed by looping the second end of the right shoulder strap 105 back onto itself and fastening the second end to a portion of the strap 105, thus creating the pull handle 115. Pulling the left shoulder pull handle 115 pulls a portion of the right shoulder strap 105 through the left shoulder adjusting buckle 125 which, when the full-body harness is worn, thereby grips and holds the right shoulder strap 105 in a tightened position, thereby adjusting the left shoulder strap 104.

Figure 4:
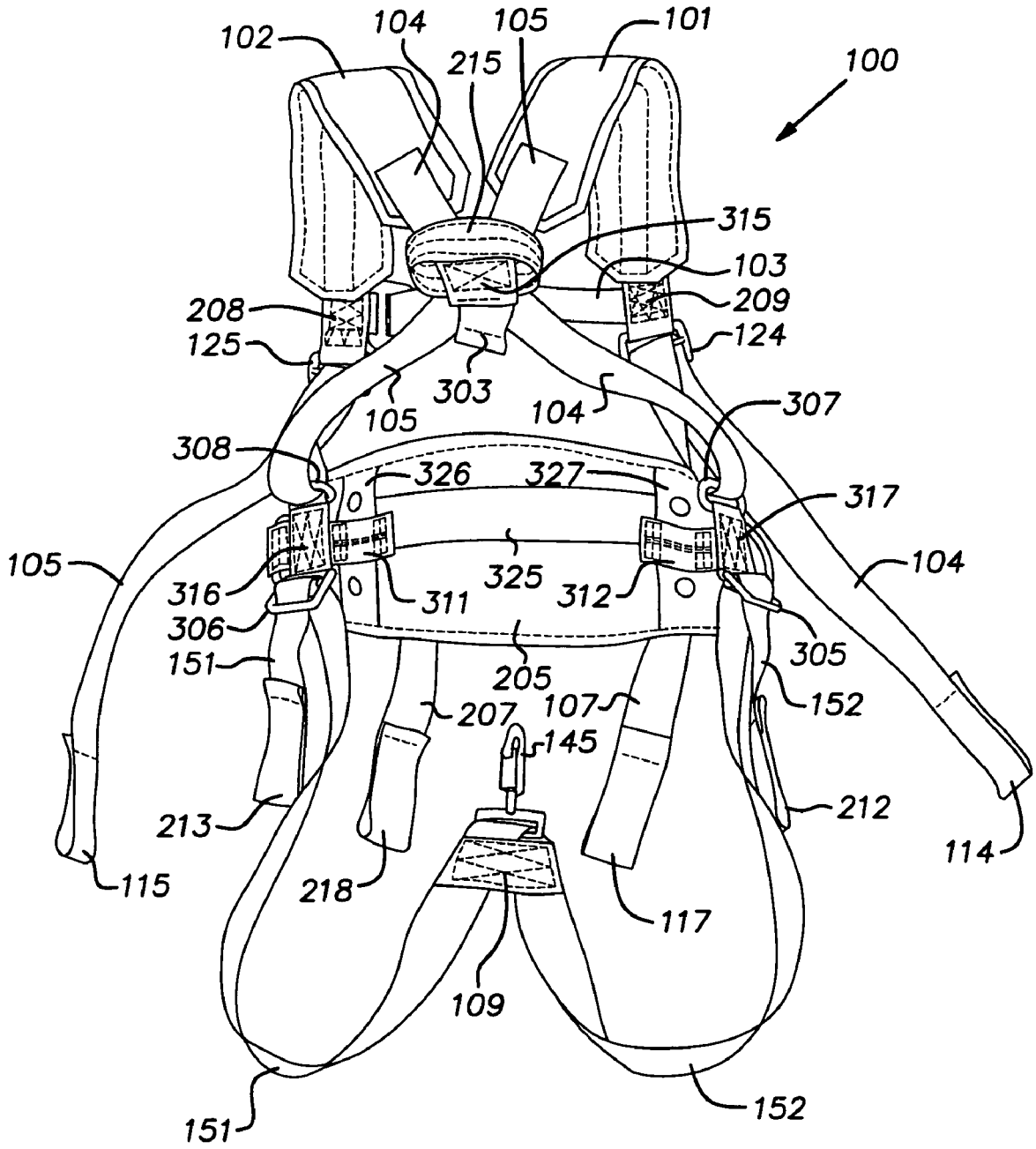
FIG. 4 shows a schematic of a back view of the embodiment of the full-body harness.

The right and left shoulder adjusting buckles 124, 125, are chosen such that when the corresponding shoulder strap 104, 105, respectively, is pulled through it as described hereinabove, the corresponding buckle 124, 125 is designed to then catch the corresponding shoulder strap 104, 105, such that it is maintained under tension, and will not loosen. The shoulder buckles are further designed such that they tend to increase their ability to hold onto the straps as the tension in the strap increases. Accordingly, the shoulder straps 104, 105 are unlikely to loosen under use when the full-body harness is properly installed and worn. The buckles used for one preferred embodiment are shown in FIGS. 4 and 5, although various other types of buckles may also be used.

FIGS. 1 and 3 also show a right waist strap 107 and a left waist strap 108. Also shown are a right waist pull handle 117 connected to a first end of the right waist strap 107, and a left waist pull handle 218 (FIG. 2) connected to a first end of the left waist strap 108.

The waist pull handles 117, 218 can be separate components connected to the first ends of the waist pull straps 107, 108, respectively, or, preferably, the waist pull handles 117, 218 can be integrally formed with the waist pull straps 107, 108, by looping the first end of the corresponding waist pull strap back onto itself and fastening the end to a portion of the corresponding waist pull strap, such as by sewing, thus creating the pull handle.

A second end of the right waist strap 107 is connected to a waist buckle clip assembly 141 by looping the second end of the right waist strap 107 through the waist buckle clip assembly 141, and also through a harness ring 150 and then sewing the second end to a portion of the right waist strap 107 onto a portion of the right waist strap 107 between the harness ring 150 and the waist buckle clip assembly 141. The harness ring 150 is loosely attached to the right waist strap 107, but little lateral motion is allowed. The harness ring 150 is for attaching a rope or other safety device thereto to provide a safety connection. Typically, the rope or safety device would have some form of a clip assembly similar to the waist buckle clip assembly 141 for attaching the rope to the harness ring 150. Alternative means of connecting the harness ring 150 to the full-body harness are also within the scope of the invention.

Similarly, a second end of the left waist strap 108 is connected to a waist buckle loop 143 by looping the second end of the left waist strap 108 through the waist buckle loop 143 and then sewing the second end to the waist strap 108. The harness ring 150, or an additional harness ring (not shown), could also be incorporated with the left waist strap 108 as described for the right waist strap 107 hereinabove, if desired.

When installing the full-body harness on a person, the preferred embodiment has the waist buckle clip assembly 141 connected, via a clip device, to the waist buckle loop 143, thus operatively connecting the right waist strap 107 to the left waist strap 108. Removing the harness requires that the clip of the waist buckle clip assembly 141 be unattached from the waist buckle loop 143. The clip should preferably be some type of safety clip that cannot be inadvertently disconnected under use, but can be manually disconnected without too much difficulty. Although the preferred embodiment uses a clip assembly/loop arrangement for operatively connecting the waist straps 107, 108, numerous other connecting mechanisms can also be employed without straying from the inventive concept.

The right waist strap 107 is moveably connected to, and loops through, a right waist adjusting buckle 126. Further, the left waist strap 108 is moveably connected to, and loops through, a left waist adjusting buckle 226.

These waist adjusting buckles 126, 226, operate similarly to the shoulder adjusting buckles 124, 125. The waist fitting of the full-body harness is adjusted by pulling on the left and right waist pull handles 117, 218, to pull the right and left waist straps 107, 108 through the corresponding waist adjusting buckles 126, 226. The waist adjusting buckles 126, 226 then grip the corresponding waist straps 107, 108 while the waist straps are under tension, keeping a proper adjustment. More tension on each waist strap typically will increase the grip thereon by the corresponding waist adjusting buckle, making the straps unlikely to loosen under use when the full-body harness is properly installed and worn. Reducing the tension on the waist straps allows the waist strap adjustment to be manually loosened.

A left leg strap 151 and a right leg strap 152 are shown in FIGS. 1-4. These leg straps connect at a crotch end 109, as shown in FIGS. 1 & 3. Preferably, the left and right leg straps 151 and 152 are comprised of a single strap which is then folded over forming a loop which traps a leg buckle clip assembly 145, and then fixing the folded loop at crotch end 109 by sewing the overlap portion, thus forming crotch end 109.

The leg buckle clip assembly 145 will preferably be similar to the waist buckle clip assembly 141. The leg clip assembly 145 is meant to be connected to the waist buckle loop 143 when the full-body harness is put on, providing buttocks support described in more detail later below.

Now referring to FIGS. 2 and 4, the left and right leg straps 151 and 152 each form a "loop" that is used to support the buttocks of the individual 1 wearing the full-body harness 100. A left leg strap 151 is looped through a left leg adjusting buckle 306, while a right leg strap 152 is looped through a right leg adjusting buckle 305. The leg adjusting buckles 305, 306 are preferably of a similar design and operation to the shoulder adjusting buckles 124, 125, described hereinabove.

Referring to FIGS. 3 and 4, a second end of the left leg strap 151 has a left leg pull handle 213, while a second end of the right leg strap 152 has a right leg pull handle 212. The left and right leg pull handles 212, 213 can be separate components connected to second ends of the leg straps 151, 152, respectively, or, alternatively, the leg pull handles 213, 212 can be integrally formed with the corresponding leg strap by looping the first end of the corresponding leg strap back onto itself and fastening the end to a portion of the corresponding leg strap, thus creating the pull handles 212, 213.

FIGS. 2 & 4 further show that the shoulder straps 104, 105 cross over and are connected at central back connection point 315. Further, a back loop 215 made from strap material is shown connected to the central back connection point 315. Back loop 215 can be used for stowage purposes, for example, or for connecting to additional equipment. Also connected to the back loop 215 is a central strip 303 of strap material sewn to connection point 315.

As further shown in FIGS. 2 & 4, the right shoulder strap 105 crosses over at the central back connection point 315, and continues on to loop through left back ring 308, with the right shoulder strap continuing on to loop through the left shoulder adjusting buckle 125, and finally ending at the left shoulder pull handle 115, as described hereinabove.

Similarly, the left shoulder strap 104 crosses over at the central back connection point 315, and continues on to loop through right back ring 307, with the left shoulder strap continuing on to loop through the right shoulder adjusting buckle 124, and finally ending at the right shoulder pull handle 114, as described hereinabove.

Also shown in FIGS. 2 & 4, the right and left back rings 307, 308 have a short length of strap material looping through them with both ends of each loop of strap material connected to an opposite end of a back strap 325 at right and left back connection points 317, 316, respectively, the ends preferably being sewn together and to the back strap 325. Also shown is a back pad 205, which is connected to the back strap 325 by sewing ends of the back strap 325 to ends of the back pad 205, such as at right and left back connection points 317, 316, or other points nearby.

Further shown are the right leg adjusting buckle 305 and the left leg adjusting buckle 306, also connected to the back strap 325 by looping a short length of strap material through them and sewing the ends together and to the back strap 325 at the corresponding right and left back connection points 317, 316. Preferably, the same short strap length can be used to secure both the left/right leg adjusting buckles 306, 305, and the corresponding left/right back rings 308, 307, by looping and folding one end of the strap through the buckle and the other end through the corresponding ring, and sewing the ends at the corresponding back connection point, for example.

Although not shown in FIGS. 2 & 4, the waist adjusting buckles 126, 226 (seen in FIG. 3) are also preferably connected to the back pad 205 by looping ends of the back strap 325 therethrough, and folding and sewing these ends to a portion of the back strap 325 and the back pad 205, to secure the buckles 126, 226 thereto at, or near, the back connection points 317, 316. Alternatively, a short length of strap material could be looped through each buckle with the ends sewn together either at, or near, the back connection points 317, 316.

Waist ring 250, shown in FIG. 3, is also preferably connected to the back pad 205 by using a length of strap material that goes through the waist ring 250 with both ends sewn to the back pad 205. It is possible to utilize the same length of strap material used for a nearby purpose, such as the length of strap used to connect the right waist adjusting buckle 126, or by using ends of the back strap 325 looped therethrough. The connection to the back strap 325 is at, or near, the back connection point 317.

Additional features shown in FIGS. 2 & 4 include left and right short back straps 326, 327, with female snap portions embedded therein. Left strip 311 and right strip 312 are shown sewn to the back strap 325.

The typical scenario for putting the full-body harness 100 on will now be described. Note that FIGS. 1 & 2 show front and back views, respectively, of the harness being worn by an individual. First, the full-body harness should have the waist buckle clip assembly 141 and the leg buckle clip assembly 145 clips disconnected from the waist buckle loop 143. The chest buckle 123 should also be disconnected. Further, all straps should be manually loosened, if necessary, to easily slip on the harness.

The harness is then put on the individual 1 by placing the shoulder pads 101, 102 over each shoulder. The chest buckle 123 can then be connected. The waist buckle clip assembly clip can also be attached to the waist buckle loop 143. Further, the leg buckle clip assembly 145 and crotch end 109 should be pulled between the legs of the individual 1, and the leg buckle clip assembly 145 clip can be connected to the waist buckle loop 143.

The individual 1 can adjust the full-body harness by pulling the chest pull handle 113 to adjust the chest strap 103; pulling the right and left shoulder pull handles 114, 115, to adjust the right and left shoulder straps 105, 104; pulling the right and left waist pull handles 117, 218 to adjust the waist straps 107, 108; and pulling the right and left leg pull handles 212, 213 to adjust the right and left leg straps 152, 151. Due to the interconnectivity of the various straps, the adjustments interact such that a better fit may be obtained by first grossly adjusting the various straps but allowing some play, and then fine-tuning the adjustment as necessary.

The harness can be removed by disconnecting the various buckles and clips. Some manual loosening of the various straps through the adjusting buckles may first be required in order to easily disconnect the connecting buckles. Through use of these various buckles and fasteners, the harness can be converted between class I, II, and III configurations.

Figure 7:
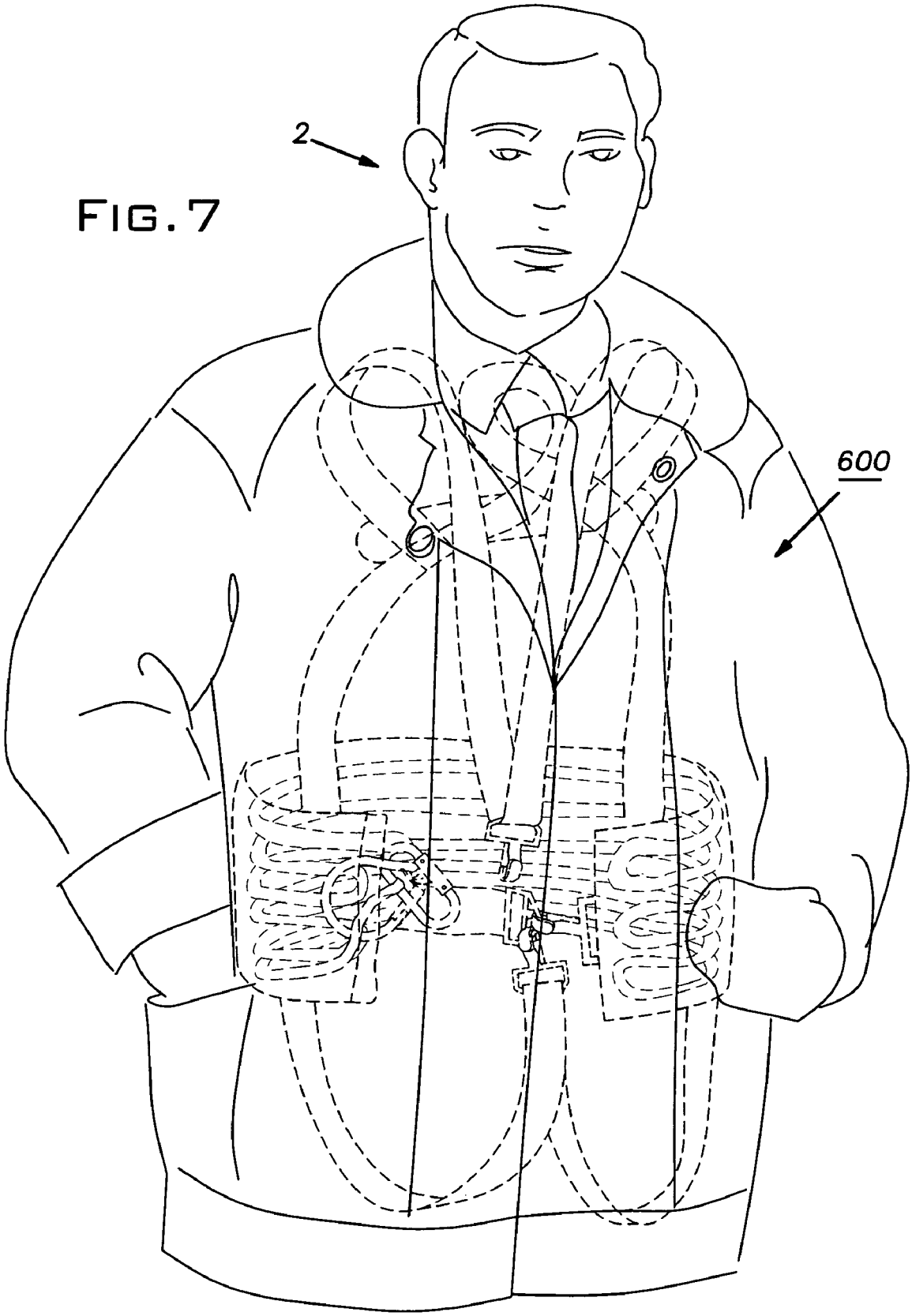
FIG. 7 is a schematic of a front view of an embodiment of the full-body harness with integral support line being worn by an individual.

Next, modifications for integrating a support line to a full-body harness will be described. The wearer 2 is shown in FIG. 7 with the embodiment of a full-body harness combined with integral support line 600 (hereinafter the full-body harness), worn in a proper fashion.

Figure 8:
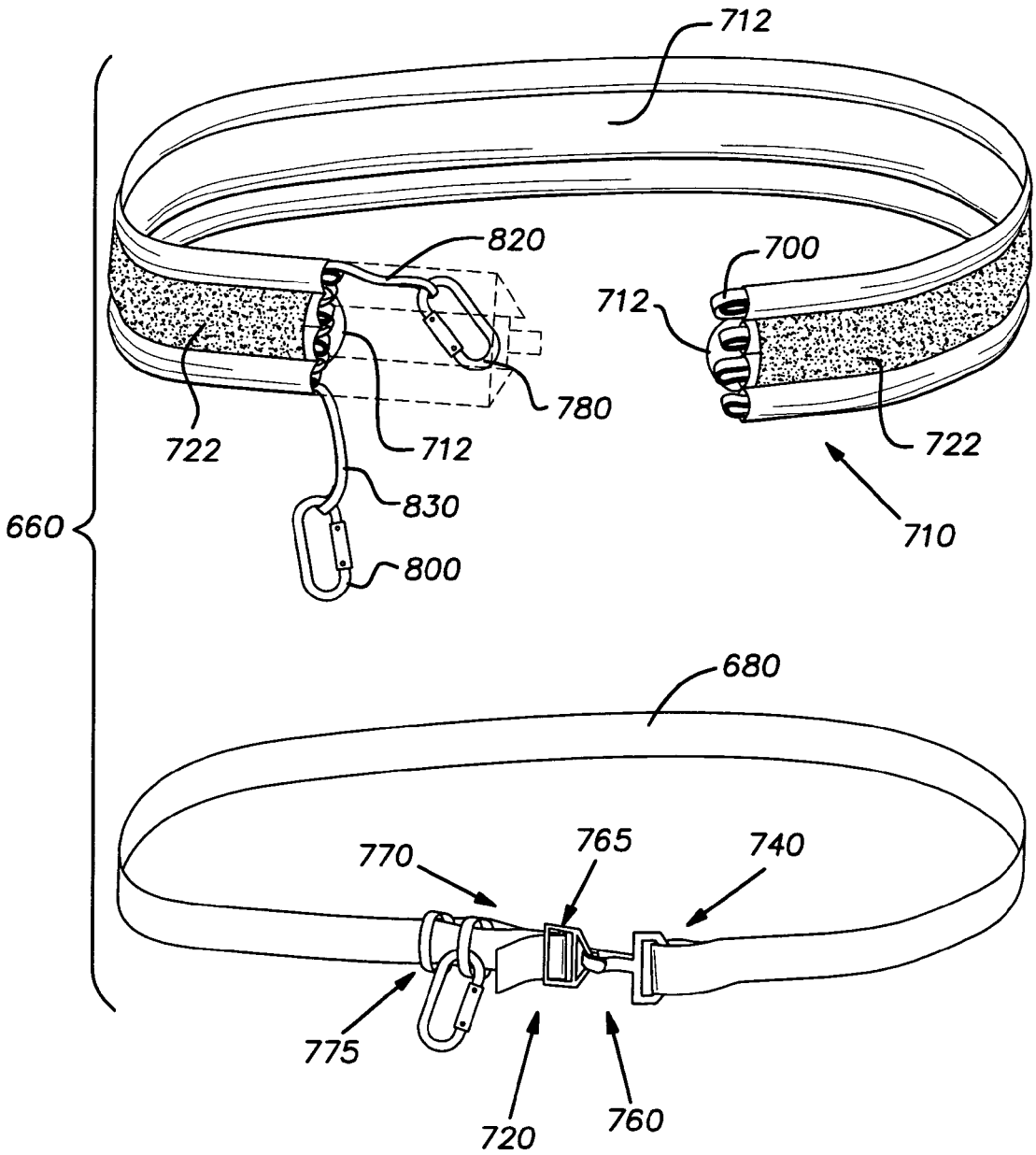
FIG. 8 is a schematic of an exploded perspective view of the harness body and support line module according to the present invention.

FIG. 8 shows an exploded view of the embodiment of the class I harness assembly with the integral support line, without showing further attachments for modification to a class II or class III harness, which was described hereinabove. The harness assembly 660 includes a harness body portion 680 (which could be a waist strap assembly made up of one or two waist straps, for example), a support line module 710, and a support line 700. The support line is constructed from a durable, high strength material, such as Kevlar® tubular webbing, for example. The harness body portion 680 has a first end 720 and a second end 740. A loop of material 770 is secured to the harness body portion first end 720, preferably by stitching or equivalent permanent attachment means. In addition, a second loop 775 may be provided to allow for attachment to a ladder or position hook (not shown). A harness body clip 760 and adjusting buckle 765 are provided to adjust the tightness of the harness body portion and to removably secure the first and second ends 720, 740 together, as illustrated.

The support line module 710 is shaped generally as a hollow pouch or length of material, and is adapted to receive the support line 700. More preferably, and as illustrated in FIG. 8 the support line module 710 defines a series of elongated, hollow chambers which each receive a portion of the support line 700. As discussed previously, because the support line is preferably shaped as a flat ribbon, several loops of the support line 700 may be received in each of the elongated chambers.

The support line module 710 also defines, at one side, a harness chamber 712 into which the harness body portion 680 is slidably inserted. During assembly, the harness body portion 680 is slidably inserted or threaded through the harness chamber 712, and the first and second ends 720, 740 of the harness body portion 680 project from opposite ends of the harness chamber 712. When the harness body portion is inserted into the harness chamber 712, the support line first and second ends 820, 830, with associated first and second carabiners 780, 800, positioned near the harness body portion first end 720. The second carabiner 800 is secured to the harness body loop 770, or in the alternative, to a hook or carabiner fastened to the harness body loop 770.

The support line module 710 also preferably has a securing fastener 722, such as a strip of one gender of hook-and-loop type fasteners, attached to the outer surface of the module 710. The securing fastener 722 cooperates with an opposite gender mating fastener (not shown) provided on the inside surface of the coat or other protective gear to removably secure the harness assembly 660 to the outer gear.

In the construction shown in FIG. 8, the module 710 may be easily removed and replaced after use of the support line to provide a new support line for future use. Once the support line 700 is deployed or removed from the support line module 710, and thus likely needs to be replaced, the harness assembly 660 may be removed from the coat or pants, and the harness body portion 680 is slidably removed from the harness body chamber 712. The harness body portion 680 may then be slidably inserted into a harness body chamber of a new module having a fresh or new support line 700 therein, and then the original harness body portion 680 and new support line module 710 are re-installed in the coat or pants. Accordingly, this construction greatly simplifies replacement of the support line. This is considered quite important in safety harness applications wherein a support line may only be used one time before it is discarded, or where the line may often be damaged during use.

Figure 9:
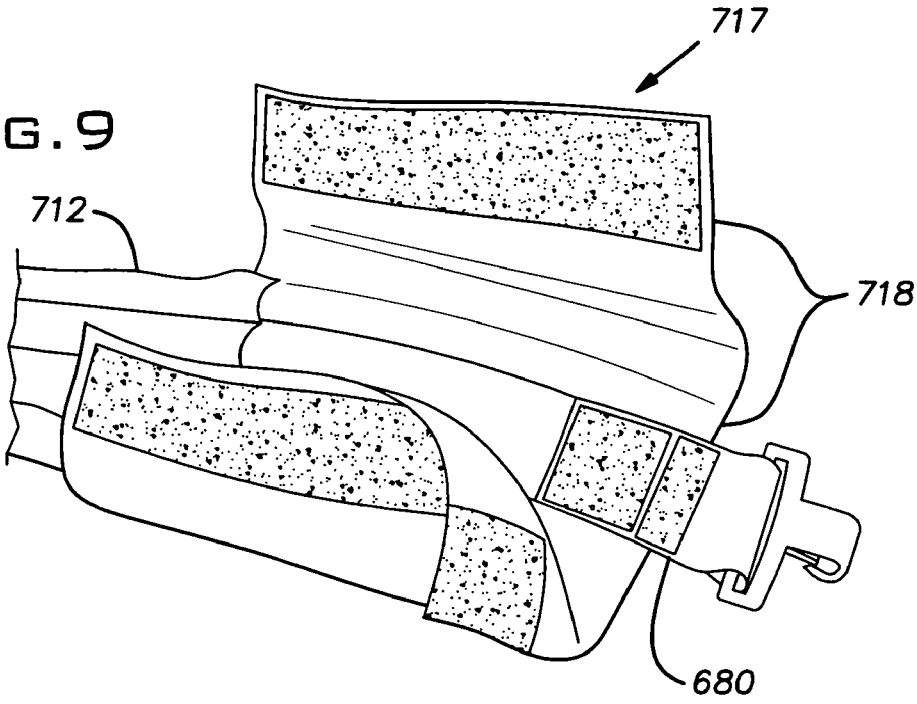
FIG. 9 is a schematic of a perspective view of a sleeve enclosure for the harness and support line hardware.

Referring to FIG. 9 a further embodiment of the invention includes a sleeve 717 attached to an end of the harness chamber 712. The sleeve 717 consists of a sheet of durable fabric designed to fold together to enclose the carabiners 780, 800 (shown in FIG. 8) and any other support line and harness hardware. The folded ends of the sleeve 717 and the end of the harness body portion 680 are fastened together, utilizing, for example, mating hook-and-loop type fastener strips 718 to secure the sleeve in the closed condition and allow for easy access of the harness and support line hardware.

Figure 11:
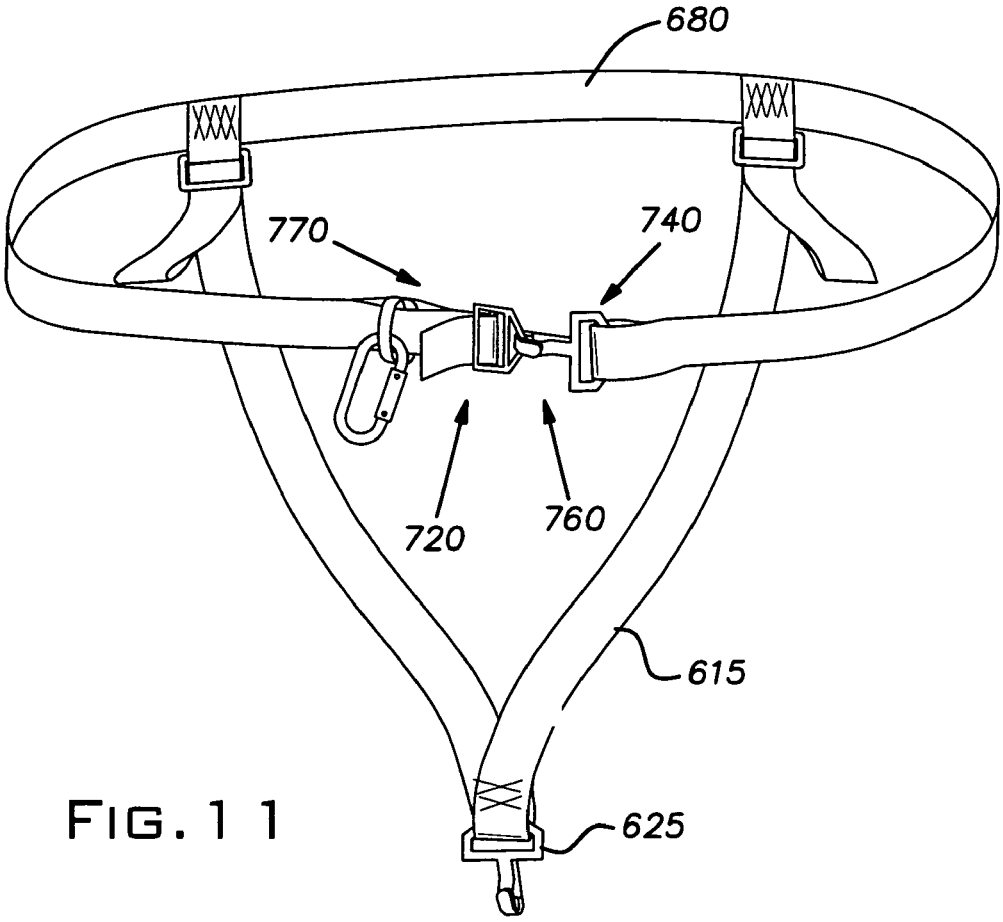
FIG. 11 is a schematic of a perspective view of the harness body with leg strap attachment for adaptation to a class II harness.
Figure 10:
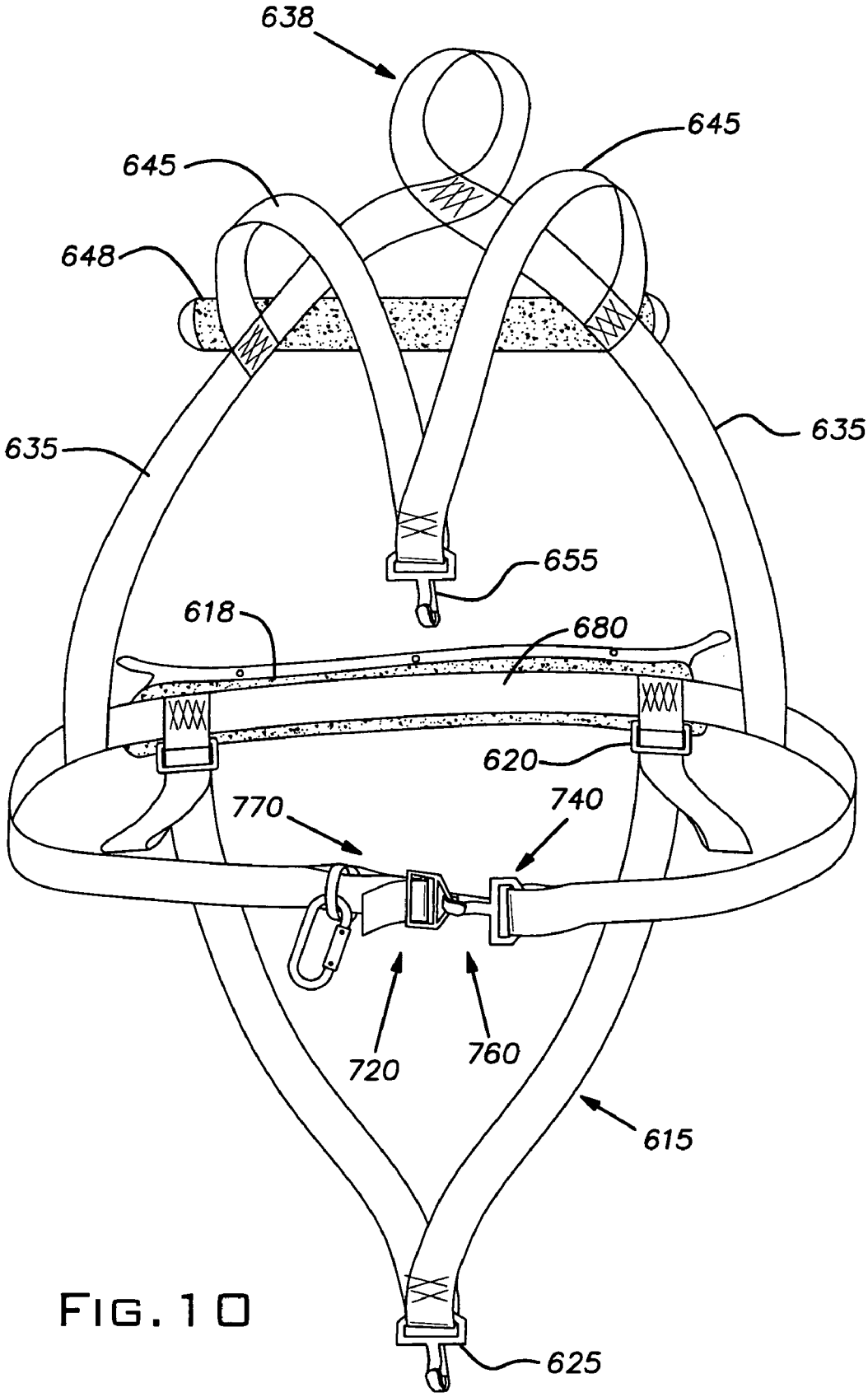
FIG. 10 is a schematic of a perspective view of the harness body with both leg strap and shoulder strap attachments for adaptation to a class III full body harness.

FIG. 10 shows a front view of the full-body harness 600 without the integral support line module 710, whereas FIG. 11 shows a respective class II harness embodiment, also without the integral support line module.

The harness further comprises a leg strap 615, shown in FIGS. 10 and 11, a portion of which is fastened to the back portion of the harness body portion 680, through openings in the harness chamber 712 (shown in FIG. 8), by adjusting buckles 620, which allow for adjustment of the length that the leg strap extends from the harness body portion 680, to properly fit around the legs of the wearer. Alternately or additionally, adjusting buckles could be installed on shoulder straps 645 for the same or different purpose. A leg strap clip assembly 625 is connected to an end of the leg strap 615, and fastens to the front portion of the harness body portion 680, or to a suitable buckle or other fastener connected thereto, where the leg strap 615 is slipped around the groin of the wearer 2, creating the class II harness. A leg strap pouch 618 may be fastened to the outside of the rear portion of the harness body portion 680, or alternatively to the outside of the harness chamber 712, and is designed to contain the leg strap 615 when it is not in use. A pull cord (not shown) or similar device may be attached to the leg strap 615 to provide for easy deployment of the leg strap 615 from the pouch 618 in the event of an emergency.

This embodiment of the invention includes a back strap 635 attached to the back of the harness body portion 680, through openings in the harness chamber 712 (seen in FIG. 9, but not shown in FIGS. 10/11), at two points (not shown) to the outside of the waist strap pouch 618 or harness body portion 680. The back strap 635 may be configured and reinforced to form a loop 638 at the upper portion of the harness 600, suitable for carrying, dragging, or supporting an incapacitated wearer of the harness.

Referring again to the embodiment of FIG. 10, attached to the sides of the back strap 635 is the shoulder strap 645. Additionally, buckles or similar devices (not shown) may be employed to adjust the shoulder strap 645 to better fit the wearer. A shoulder strap clip assembly 655 is connected to an end of the shoulder strap 645 and fastens to the front portion of the harness body portion, or to a suitable buckle or other fastener connected thereto, when the shoulder strap 645 is slipped around the shoulders and chest of the wearer, creating the class III harness when combined with use of the leg strap 615. A shoulder strap pouch 648 is preferably fastened to the back of the shoulder portions of the back strap 635 and is designed to contain the shoulder strap 645 when it is not in use. A pull cord (not shown) or similar device may be attached to the shoulder strap 645 to provide for easy deployment of the shoulder strap 645 from the pouch 648 in the event of an emergency. The back strap 635 or shoulder strap pouch 648 may be fastened to the inside of the wearer's turnout gear or coat in order to maintain its upright position while the shoulder strap 645 is not in use.

In an alternate embodiment (not shown), the back strap 635 and shoulder strap 645 may both be stored in a pouch attached to the harness assembly 660, and a mechanism, such as a pull cord, may be used to deploy both the back strap 635 and shoulder strap 645 in case of an emergency.

Figure 12:
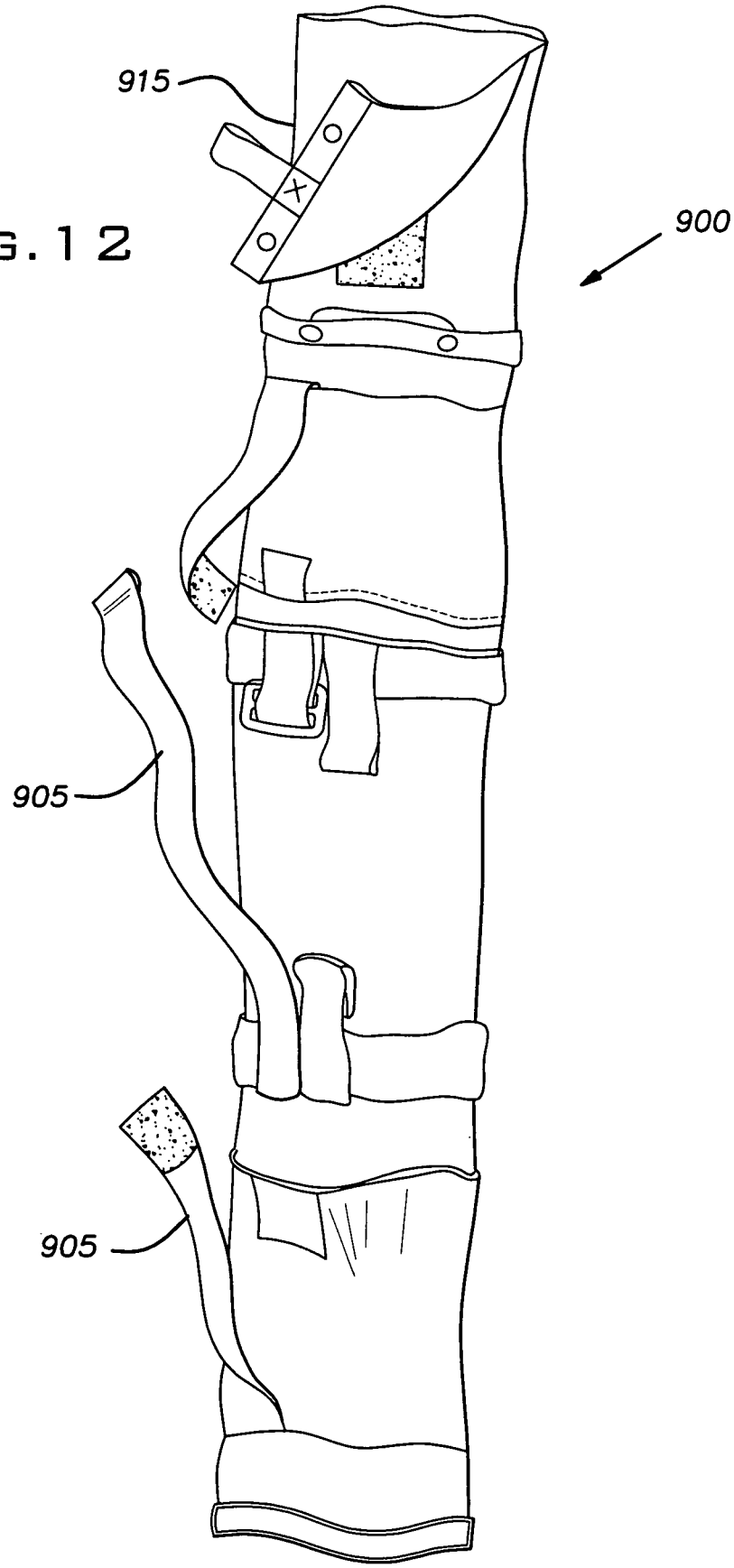
FIG. 12 is a schematic of a perspective view of a cover for the support line module that provides for mounting of a self contained breathing apparatus (SCBA) unit.
Figure 13:
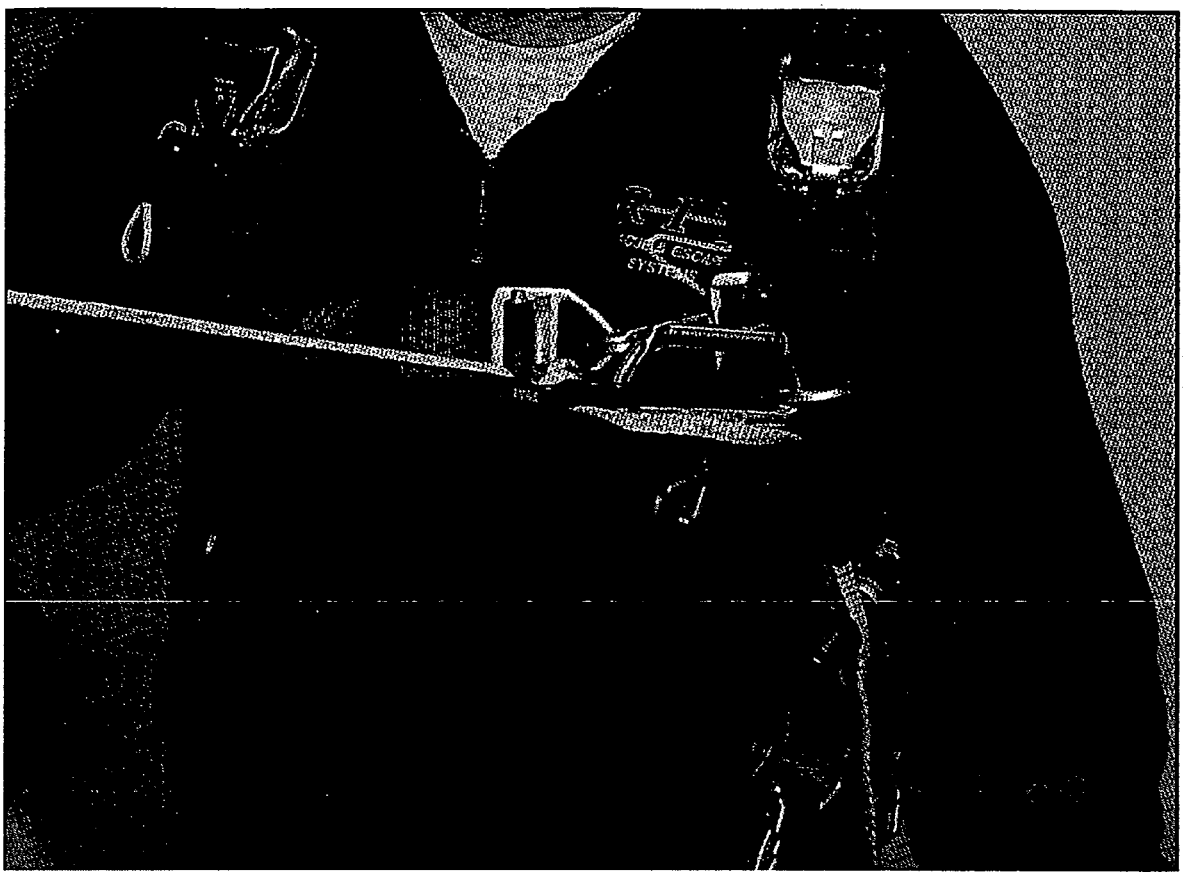
FIGS. 13-17 show an embodiment of a personnel lowering device (PLD) utilizing a harness, a support line in a carrying device, and a parachute.
Figure 14:
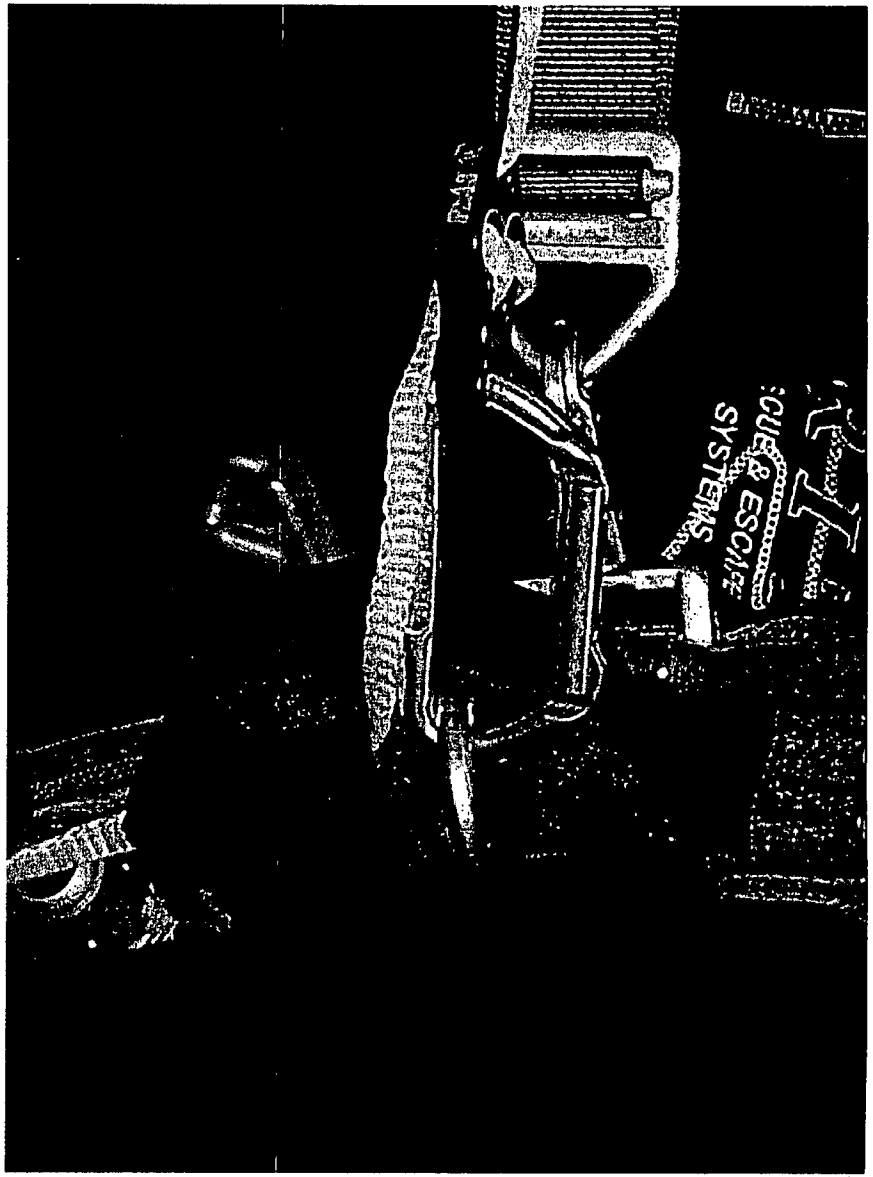
Figure 15:
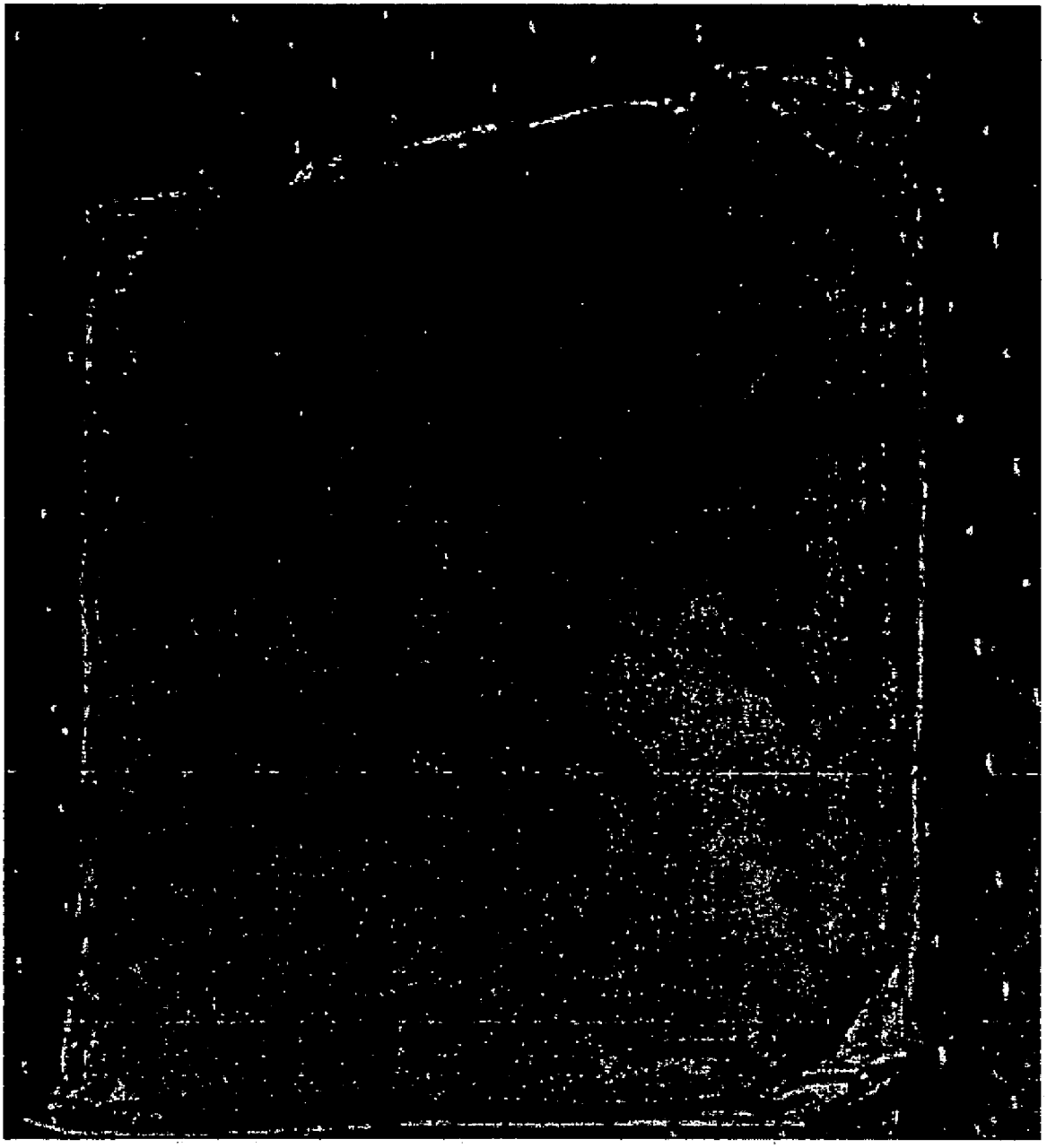
Figure 16:
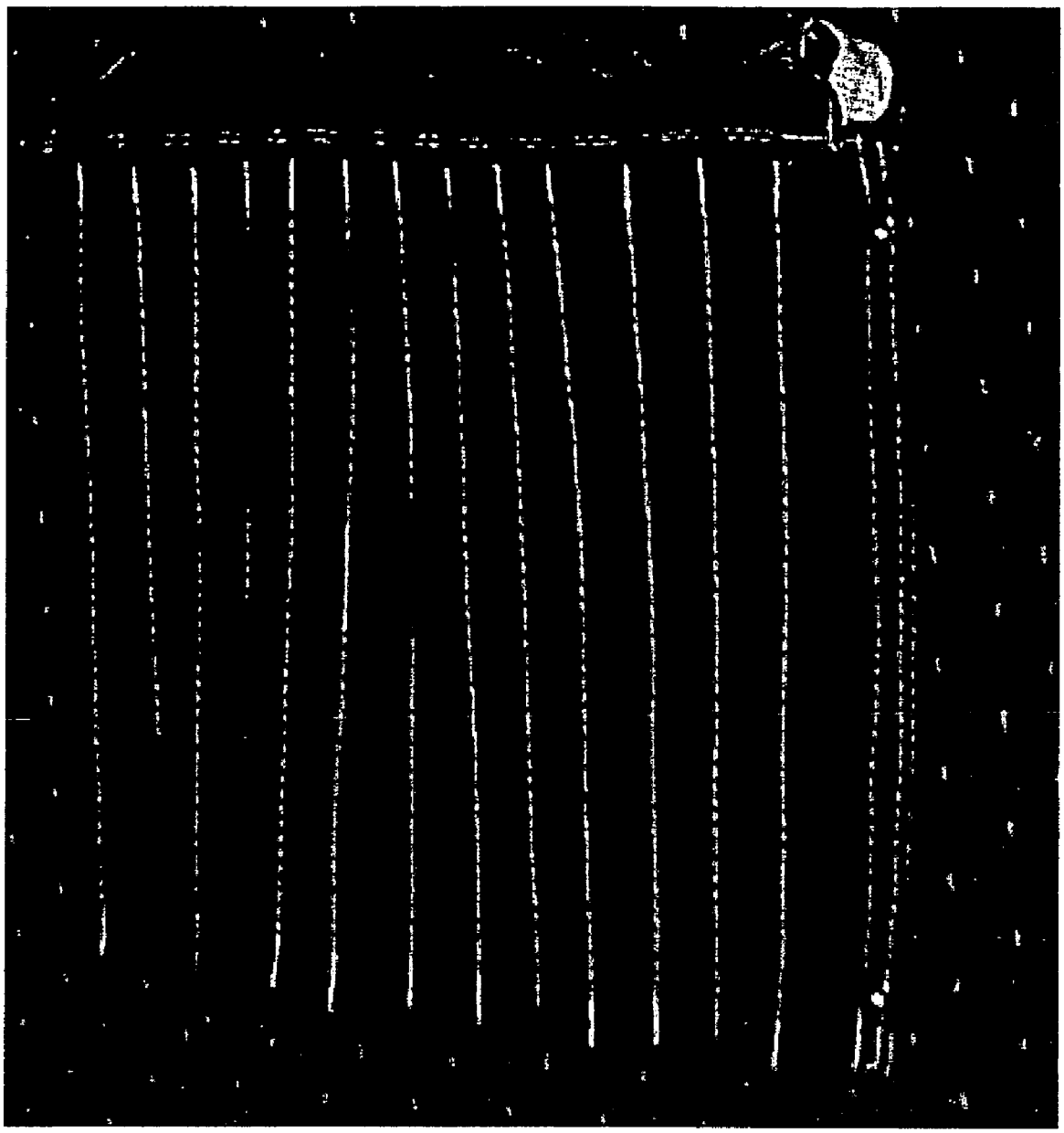
Figure 17:
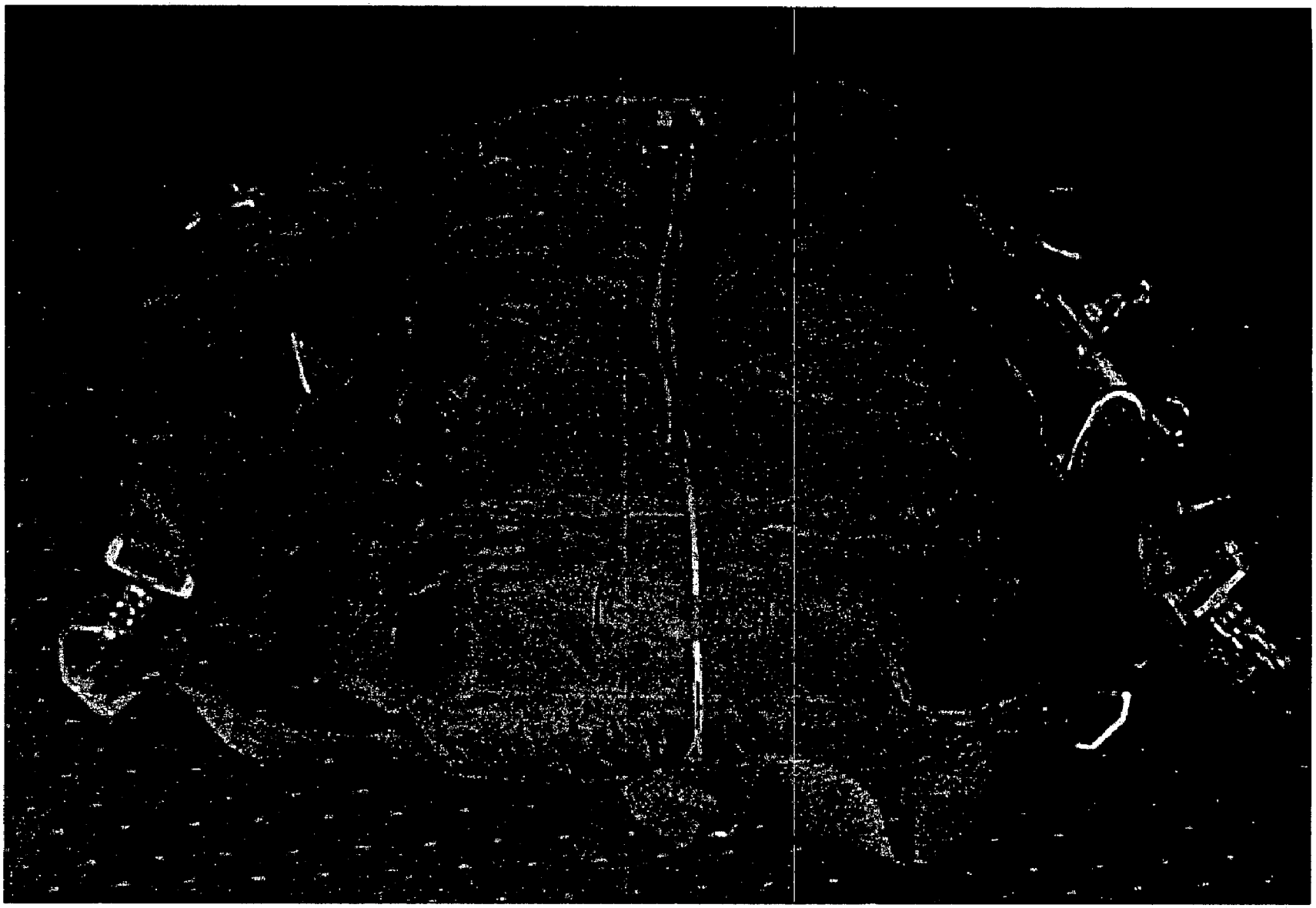

FIG. 12 shows a housing 900 that, in an alternative embodiment, adapts the harness system for mounting of a self-contained breathing apparatus (SCBA), including oxygen tank, commonly used by firefighters (SCBA not shown). The housing 900 is slipped over the harness body portion 680 and harness chamber 712, shown in FIG. 8, and has openings provided for access by the leg strap 615 and shoulder strap 645, shown in FIG. 10. The housing 900, preferably constructed of a durable fabric, utilizes one or more straps 905 and tabs 915 to tether portions of the SCBA (not shown) to the back of the harness.

In first use of the harness of FIG. 10, the harness base assembly 660 is put on a wearer by fastening the ends 720, 740 of the harness body portion 680 around the waist of the wearer. The back strap 635 and back of the support line module 710 (FIG. 8) are fastened to the inside fasteners of an outer coat or other outer gear to be worn by the wearer, or may be fastened to the SCBA housing 900 (FIG. 12). As needed, the leg strap 615 may be deployed from the leg strap pouch 618, pulling the strap 615 between the wearer's legs, and attaching the leg strap clip assembly 625 to the front portion of the harness body portion 680, or to a suitable buckle or other fastener connected thereto, thereby comprising the class II harness (an embodiment of which is shown in FIG. 11 without the shoulder straps). Further, the shoulder strap 645 (see FIG. 10) may be deployed from the shoulder strap pouch 648, pulling the strap 645 over the shoulders, head, and chest of the wearer, and attaching the shoulder strap clip assembly 655 to the front portion of the harness body portion 680, or to a suitable buckle or fastener connected thereto, thereby comprising the class III harness. As indicated above, a pull cord or other such mechanism may be utilized for the wearer to more easily access the leg and shoulder straps 615, 645 while the harness 600 and outer gear is worn.

Note that modifications similar to those described above can be made to the full-body harness embodiments shown in FIGS. 1-3 to adapt it for use with the integral support line and/or SCBA housing.

Furthermore, the full-body harness or any variation described herein can also be adapted for various other uses. In one such application, a harness can be attached to a parachute for safety, emergency, and/or entertainment (e.g., skydiving) applications.

For example, one of the disclosed harnesses with or without the disclosed egress system (the support line and/or support line module as disclosed herein) can be adapted for use in conjunction with a military parachute. This system is referred to by the military as a PLD (personnel lowering device).

The harness can also be used by the Oil and Gas Industry, the Construction Industry, the Utility and Telecom Industry and Municipalities for various safety and emergency functions.

Furthermore, any of the above harnesses could also be adapted to include an SCBA attachment, for example as disclosed herein, to provide additional functionality, such as for application where the air is tainted or oxygen in short supply.

FIGS. 13-17 show one embodiment of a personnel lowering device (PLD) utilizing a harness, a support line in a carrying device (e.g., module and/or pouch), and a parachute. This embodiment of the invention is used for a PLD which is provided with a pre-rigged system attached to a parachute. Simply open the pouch on shoulder strap, pull out carabiner, and wrap the riser. This PLD system requires only one hand (left or right) to deploy and use. A 6000 lb rated carabiner and Kevlar tubular webbing has at least a 5500 lb tensile strength, and a temperature rating of at least 862 degrees F. It is a pre-rigged system allowing one handed operation with a PED descender, is compact and lightweight, can be UL Certified to the NFPA 1983 standards for life safety, and provides an emergency egress/escape line is housed in a channeled pouch that prevents the line from accidentally being deployed, and adding a layer of protection as well.

Figure 18:
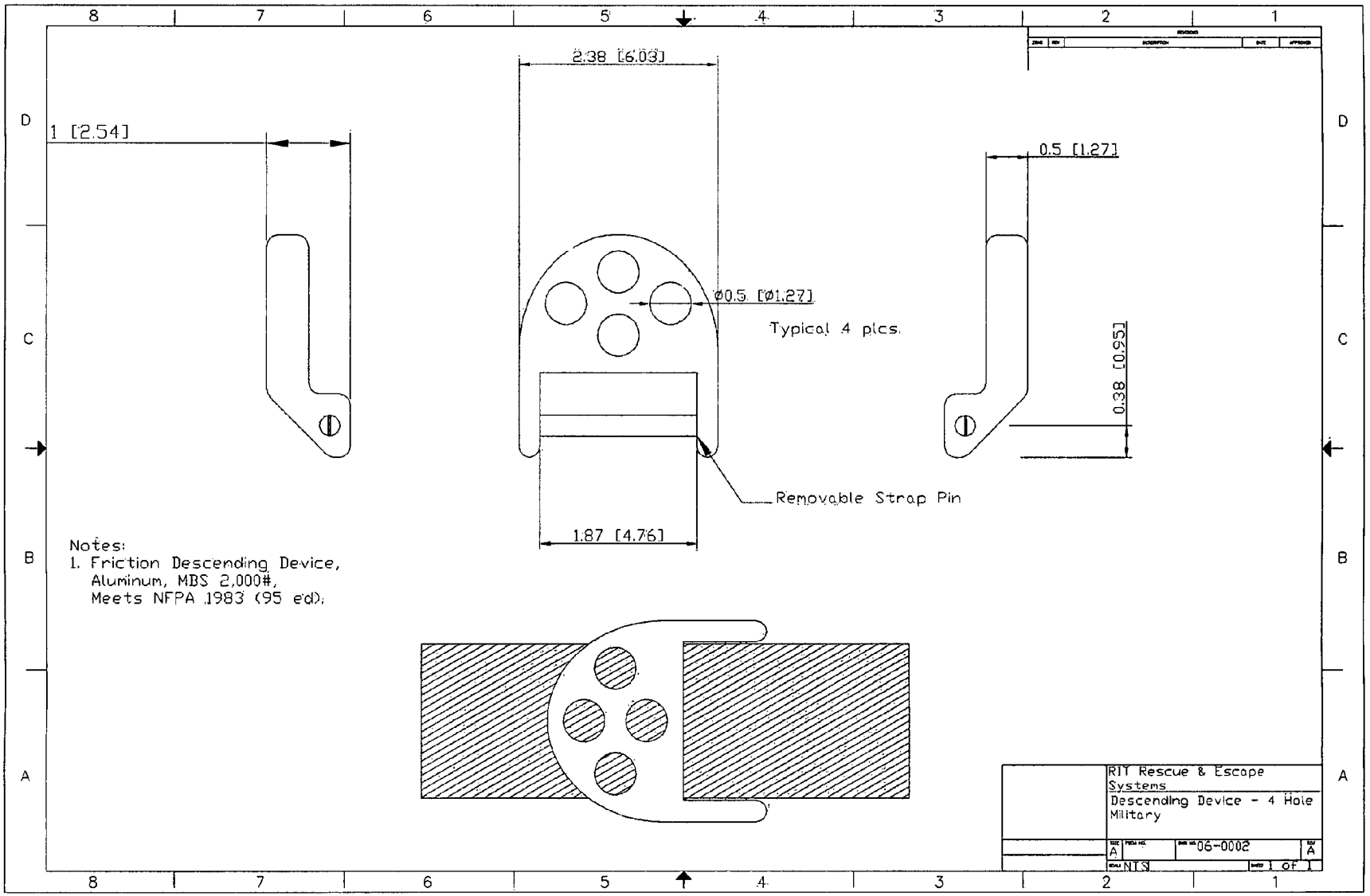
FIG. 18 shows a descending device that might be utilized with the PLD of FIGS. 13-17.
Figure 19:
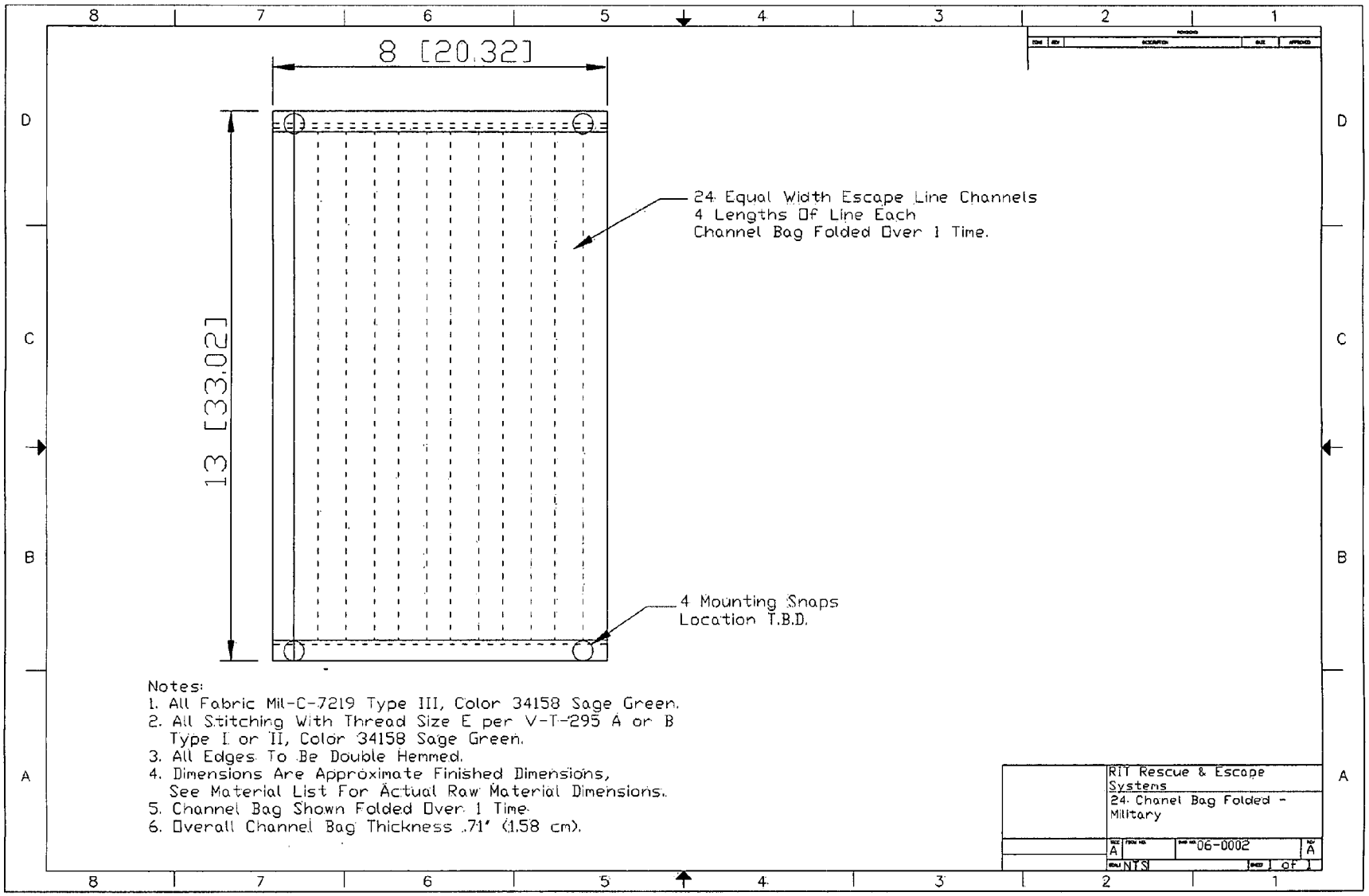
FIG. 19 shows an escape line pouch having channels as might be utilized with the PLD of FIGS. 13-18.
Figure 20:
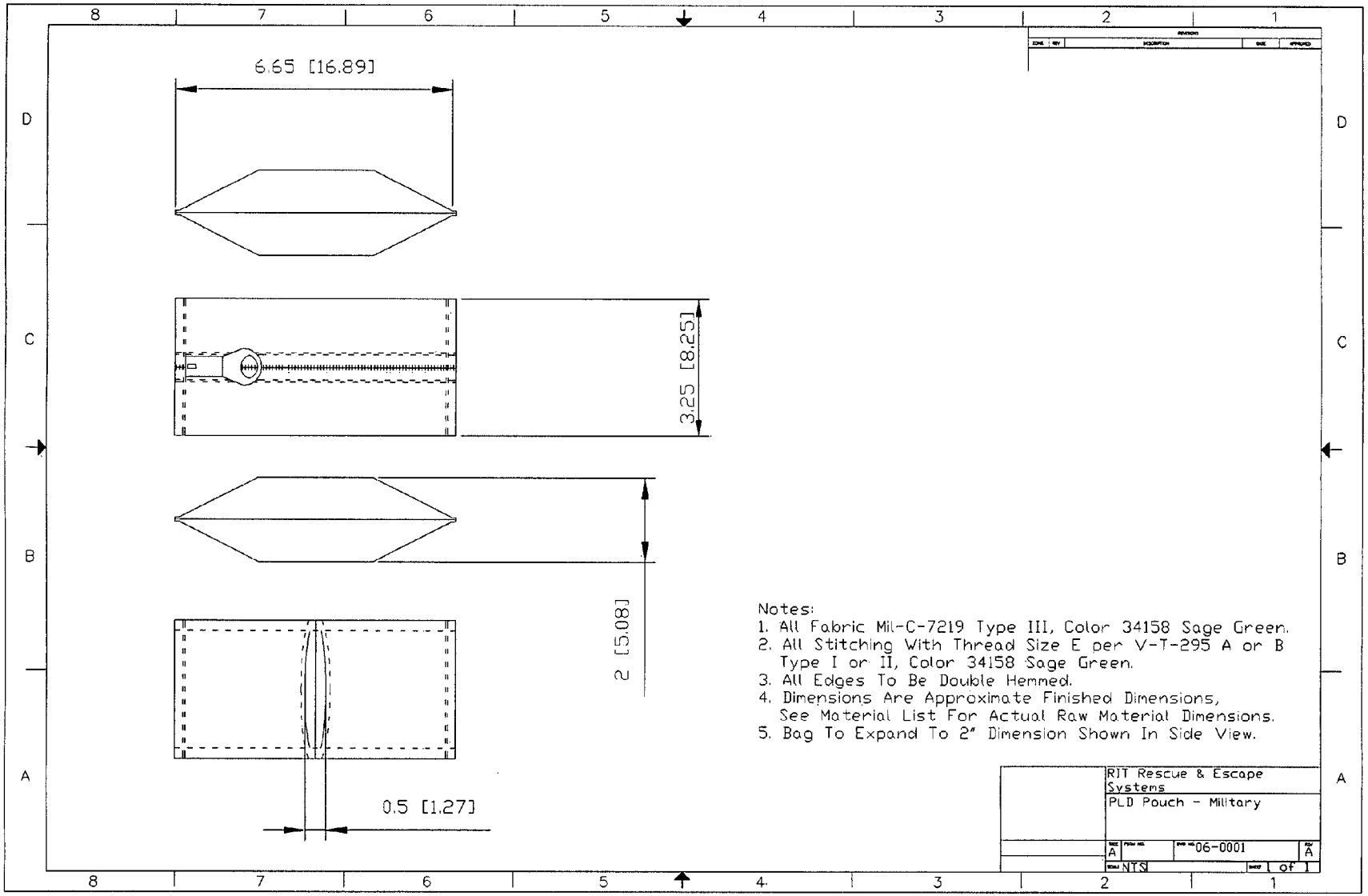
FIG. 20 shows a pouch that holds the descending device and hardware as might be utilized with the PLD of FIGS. 13-19.

FIG. 18 shows a descending device that might be utilized with the PLD of FIGS. 13-17; FIG. 19 shows an escape line pouch (module) having channels as might be utilized with the PLD of FIGS. 13-18; and FIG. 20 shows a pouch that holds the descending device and hardware as might be utilized with the PLD of FIGS. 13-19.

The invention has been described hereinabove using specific examples; however, it will be understood by those skilled in the art that various alternatives may be used and equivalents may be substituted for components or steps described herein, or the order of steps may be changed, or substitutes for the described components provided, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A harness comprising:

a left shoulder strap;

a right shoulder strap;

a waist strap for completely encircling the waist of the user;

a left leg strap;

a right leg strap, and at least one pull handle wherein said pull handle is adapted for tightening at least one of said straps about a portion of the user while being worn by the user pulling on an end of said at least one pull handle, and wherein said left shoulder strap and said right shoulder strap are held over the shoulder by one or both of:

a chest strap connected to said right shoulder strap at one location and also connected to said left shoulder strap at another location, and by connecting a first portion of said right shoulder strap to a second portion of said left shoulder strap and by also connecting a first portion of the left shoulder strap to a second portion of the right shoulder strap.

2. The harness of claim 1, further comprising a parachute.

3. The harness of claim 2, further comprising a support line connected to said waist strap.

4. The harness of claim 3, further comprising means for holding an SCBA.

5. The harness of claim 1, further comprising a support line connected to said waist strap.

6. The harness of claim 5, further comprising means for holding an SCBA.

7. The harness of claim 1, further comprising means for holding an SCBA.

8. The harness of claim 1, wherein said left leg strap is connected to said right leg strap at a connection to said waist strap.

9. The harness of claim 8, wherein said left shoulder strap and said right shoulder strap are both connected to said waist strap.

10. The harness of claim 1, wherein said left shoulder strap and said right shoulder strap are both connected to said waist strap.

11. The harness of claim 1, wherein said left shoulder strap is connected to said waist strap at a location that said right leg strap is connected to said waist strap, and wherein said left leg strap is connected to said right leg strap at a connection to said waist strap different than said location.

12. A harness comprising:

a left shoulder strap having a portion and an end;

a right shoulder strap having a portion connected to said end of said left shoulder strap, said right shoulder strap also having an end connected to said portion of said left shoulder strap;

a waist strap for completely encircling the waist of the user and having a first end and a second end and a waist connector for connecting said first end to said second end;

a left leg strap having an end;

a right leg strap having an end, wherein at least one pull handle is adapted for tightening at least one of said straps about a portion of the user while being worn by the user pulling on an end of said at least one pull handle, and wherein said end of said left leg strap is connected to said end of said second leg strap at a connection to said waist strap; and a chest strap having a first portion connected to said left shoulder strap, said chest strap also having a second portion connected to said right shoulder strap.

13. The harness of claim 12, further comprising a parachute.

14. The harness of claim 13, further comprising a support line.

15. The harness of claim 14, further comprising means for holding an SCBA.

16. The harness of claim 12, further comprising a support line.

17. The harness of claim 16, further comprising means for holding an SCBA.

18. The harness of claim 12, further comprising means for holding an SCBA.

19. The harness of claim 12, wherein said first leg strap and said second leg strap are connected together and to said waist strap at a common removable connector.

20. The harness of claim 19, wherein said common removable connector is for connecting to said waist connector.

21. The harness of claim 19, wherein said right leg strap is also connected to said waist strap at another location.

22. The harness of claim 21, wherein said left shoulder strap is connected to said waist strap at said another location.

23. The harness of claim 12, wherein said chest strap, said waist strap, said shoulder straps, and said leg straps are all made independently adjustable to fit the user.

* * * * *